US009285695B2

(12) United States Patent
Miki et al.

(10) Patent No.: US 9,285,695 B2
(45) Date of Patent: Mar. 15, 2016

(54) LATENT ELECTROSTATIC IMAGE DEVELOPING TONER

(75) Inventors: Tomoharu Miki, Osaka (JP); Takuya Kadota, Hyogo (JP); Yoshihiro Mikuriya, Hyogo (JP); Tsuyoshi Nozaki, Osaka (JP); Yoshimichi Ishikawa, Hyogo (JP); Kazuoki Fuwa, Hyogo (JP); Tomohiro Fukao, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 52 days.

(21) Appl. No.: 14/345,308

(22) PCT Filed: Sep. 12, 2012

(86) PCT No.: PCT/JP2012/073971

§ 371 (c)(1),
(2), (4) Date: Mar. 17, 2014

(87) PCT Pub. No.: WO2013/039257

PCT Pub. Date: Mar. 21, 2013

(65) Prior Publication Data

US 2014/0356774 A1 Dec. 4, 2014

(30) Foreign Application Priority Data

Sep. 16, 2011 (JP) ..... 2011-202699
Sep. 16, 2011 (JP) ..... 2011-202776
Sep. 10, 2012 (JP) ..... 2012-198546

(51) Int. Cl.
*G03G 9/08* (2006.01)
*G03G 9/093* (2006.01)
(Continued)

(52) U.S. Cl.
CPC ..... *G03G 9/0825* (2013.01); *G03G 9/08755* (2013.01); *G03G 9/09321* (2013.01);
(Continued)

(58) Field of Classification Search
CPC ..... G03G 9/0935; G03G 9/09392; G03G 9/08795
USPC ..... 430/110.2, 111.4, 109.4
See application file for complete search history.

(56) References Cited

U.S. PATENT DOCUMENTS 5,914,210 A 6/1999 Demizu et al.
8,642,238 B2 2/2014 Nozaki et al.
(Continued)

FOREIGN PATENT DOCUMENTS

JP 2002-148851 5/2002
JP 2003-330217 11/2003
(Continued)

OTHER PUBLICATIONS

International Search Report Issued Nov. 27, 2012 for counterpart International Patent Application No. PCT/JP2012/073971 Filed Sep. 12, 2012.
(Continued)

*Primary Examiner* — Mark A Chapman
(74) *Attorney, Agent, or Firm* — Oblon, McClelland, Maier & Neustadt, L.L.P.

(57) ABSTRACT

A toner including: a core particle containing at least a binder resin, a colorant and a releasing agent; and a shell on a surface of the core particle, wherein the toner gives a supernatant having a transmittance of 50% to 95% with respect to light having a wavelength of 800 nm, where the supernatant is formed after 3 g of the toner is added to 40 g of ion-exchange water containing 0.5% by mass of sodium dodecyl sulfate, followed by stirring for 90 min and by irradiating with ultrasonic waves of 20 kHz and 80 W for 5 min, and a liquid containing the toner dispersed therein is centrifugated at 3,000 rpm for 5 min.

20 Claims, 4 Drawing Sheets

(51) Int. Cl.
*G03G 9/097* (2006.01)
*G03G 9/087* (2006.01)

(52) U.S. Cl.
CPC ..... *G03G9/09342* (2013.01); *G03G 9/09371* (2013.01); *G03G 9/09392* (2013.01); *G03G 9/09716* (2013.01); *G03G 2215/0634* (2013.01)

(56) References Cited

U.S. PATENT DOCUMENTS

| | | | |
|---|---|---|---|
| 2002/0086228 | A1 | 7/2002 | Koumura |
| 2005/0064314 | A1 | 3/2005 | Fujino et al. |
| 2008/0076054 | A1 | 3/2008 | Nozaki et al. |
| 2008/0233496 | A1 | 9/2008 | Kotsugai et al. |
| 2010/0266947 | A1 | 10/2010 | Maezawa |
| 2011/0053063 | A1 | 3/2011 | Kadota et al. |
| 2011/0053071 | A1 | 3/2011 | Miki et al. |
| 2011/0164901 | A1 | 7/2011 | Yamamoto et al. |
| 2011/0250533 | A1 | 10/2011 | Kadota et al. |
| 2011/0287356 | A1 | 11/2011 | Fukao et al. |
| 2012/0219321 | A1 | 8/2012 | Fukao et al. |
| 2012/0237253 | A1 | 9/2012 | Fukao et al. |

FOREIGN PATENT DOCUMENTS

| | | | |
|---|---|---|---|
| JP | 2005-084183 | | 3/2005 |
| JP | 2005-099233 | | 4/2005 |
| JP | 2007-127685 | | 5/2007 |
| JP | 4033096 | | 11/2007 |
| JP | 2008-065099 | | 3/2008 |
| JP | 2008-089670 | | 4/2008 |
| JP | 2008-145885 | | 6/2008 |
| JP | 2008-170901 | A | 7/2008 |
| JP | 2008-268872 | | 11/2008 |
| JP | 2009-181099 | | 8/2009 |
| JP | 4385507 | | 10/2009 |
| JP | 2010-102057 | | 5/2010 |
| JP | 2010-164720 | | 7/2010 |
| JP | 2011-070179 | | 4/2011 |
| JP | 2011-095286 | | 5/2011 |
| JP | 2011-123483 | | 6/2011 |
| JP | 2011-164473 | A | 8/2011 |
| JP | 2012-208492 | | 10/2012 |
| WO | WO 2011/052794 | A1 | 5/2011 |

OTHER PUBLICATIONS

Extended European Search Report issued Jan. 27, 2015 in Patent Application No. 12831560.3.
Office Action issued May 11, 2015 in Japanese Patent Application No. 2011-202776.

LATENT ELECTROSTATIC IMAGE DEVELOPING TONER

CROSS REFERENCE TO RELATED APPLICATIONS

The present application is a 35 U.S.C. §371 national stage patent application of International patent application PCT/JP2012/073971, filed on Sep. 12, 2012, published as WO/2013/039257 on Mar. 21, 2013, the text of which is incorporated by reference, and claims the benefit of the filing date of Japanese application nos. 2011-202699, filed on Sep. 16, 2011; 2011-202776, filed on Sep. 16, 2011; and 2012-198546, filed on Sep. 10, 2012, the text of each of which is also incorporated by reference.

TECHNICAL FIELD

The present invention relates to: a latent electrostatic image developing toner for developing a latent electrostatic image formed in an electrophotographic method, an electrostatic recording method and an electrostatic printing method; and an image forming method, an image forming apparatus and a process cartridge each using the latent electrostatic image developing toner.

BACKGROUND ART

Conventionally, research and development on electrophotography have been made through various attempts and technical approaches. The electrophotographic method forms an image through a process including: charging the surface of a latent image bearing member (hereinafter may be referred to as an "electrophotographic photoconductor" or a "photoconductor"); exposing the charged surface thereof to light to thereby form a latent electrostatic image; developing the latent electrostatic image with a color toner to thereby form a toner image; transferring the toner image on a transfer target such as paper; and fixing the toner image with a heat roller.

Contact heating-type fixing methods such as hot roller fixing methods have been widely used as methods for fixing toner. The fixing device used in the hot roller fixing methods is equipped with a heating roller and a pressure roller. In the fixing device, a recording sheet that bears a toner image thereon is allowed to pass through the pressure contact area (nip area) between the heating roller and the pressure roller, melting the toner image to thereby fix on the recording medium.

Resins mainly used for toners are, for example, a vinyl polymerizable resin and a resin having a polyester skeleton. These resins are superior or inferior in terms of functional properties of toners such as flowability, transferability, chargeability, fixability and image qualities. Recently, both of the resins are used in combination, or a so-called hybrid resin having both the skeletons is used.

Known toner production methods include: conventional kneading/pulverizing methods; and so-called chemical toner methods including: suspension methods and emulsification methods using an organic solvent and an aqueous solvent; suspension polymerization methods where droplets of polymerizable monomers are controllably polymerized to directly obtain toner particles; and aggregation methods where emulsified fine particles are produced and aggregated to obtain toner particles. As the chemical toners, core-shell toners have already been known, which include a core formed of a resin advantageous for thermal fixation where the core is covered with resin particles advantageous for charging and heat resistance.

For example, there has been disclosed a latent electrostatic image developing toner including a core of polyester resin and a coating layer of vinyl resin where the coating layer is formed, on the surfaces of colored resin particles produced by the emulsification dispersion method, using resin particles produced by the emulsification polymerization method or the emulsification dispersion method using a surfactant (see PTL 1).

Also, core-shell toners have been known which use as a resin material a polyester resin advantageous for strength, heat resistance and fixability. For example, there has been known a method including: forming core particles through aggregation/salting-out of a polyester fine resin particle dispersion liquid using an aggregating salt; then additionally adding a polyester fine resin particle dispersion liquid thereto and form shells through aggregation/salting-out thereof using an aggregating salt similarly; and then fusing the shells (see PTL 2).

Also, there has been known a method where the core-shell structure is formed through a process including: dissolving a polyester resin in an organic solvent; subjecting the solution to phase-inversion emulsification to form fine resin particles; and aggregating the fine resin particles with the addition of an electrolyte (see PTL 3).

Furthermore, there has been disclosed a method where a latent electrostatic image developing toner is obtained through a process including: forming core particles through aggregation and/or fusion of at least fine resin particles and colorant fine particles dispersed in a dispersion liquid; adding a liquid containing fine resin particles dispersed therein to a liquid containing the core particles dispersed therein; and forming a coating layer through aggregation and/or fusion of the fine resin particles on the surfaces of the core particles (see PTL 4).

Many conventional core-shell toners have a toner interior (core) enveloped with a shell and are designed to achieve both heat resistant storageability and low-temperature fixability. In addition, they are designed to be improved in chargeability by using a highly functional resin in the shell, or by forming the shell in color toners to thereby reduce the effect of the colorant.

However, when a large amount of the shell is formed in the core-shell toners, the shell is removed from the toner surface and the removed shell adheres to, for example, a toner-regulating blade. Whereas when the amount of the shell is too small or insufficient, the effects of the shell are obtained to cause background smear. In addition, the external additives are considerably embedded in the toner particles after degradation, which makes the flowability thereof insufficient.

CITATION LIST

Patent Literature

PTL 1: Japanese Patent Application Laid-Open (JP-A) No. 2005-084183
PTL 2: Japanese Patent (JP-B) No. 4033096
PTL 3: JP-A No. 2008-089670
PTL 4: JP-A No. 2005-099233

SUMMARY OF INVENTION

Technical Problem

The present invention aims to provide a toner having a core-shell structure where the shell satisfactorily exhibits its functions to improve durability and chargeability of the toner and the shell removed does not adhere to a toner-regulating blade.

Solution to Problem

The present inventors conducted extensive studies to solve the above-described problems and as a result have found that, by firmly attaching the shell to the toner surface to prevent the shell from being removed, the formed toner can reliably have high chargeability and durability. The present inventors also have found that, by controlling the shell so as to be removed from the toner surface to such an extent that does not involve the adhesion of the shell onto a toner-regulating blade, the external additives can be prevented from being embedded since the removed shell serves as a spacer between toner particles to prevent the toner particles from being in direct contact therewith. The present invention has been completed on the basis of the above findings.

A toner of the present invention as means for solving the above problems includes:

a core particle containing at least a binder resin, a colorant and a releasing agent; and a shell on a surface of the core particle, wherein the toner gives a supernatant having a transmittance of 50% to 95% with respect to light having a wavelength of 800 nm, where the supernatant is formed after 3 g of the toner is added to 40 g of ion-exchange water containing 0.5% by mass of sodium dodecyl sulfate, followed by stirring for 90 min and by irradiating with ultrasonic waves of 20 kHz and 80 W for 5 min, and a liquid containing the toner dispersed therein is centrifugated at 3,000 rpm for 5 min.

Advantageous Effects of Invention

The present invention can provide a toner having a core-shell structure where the shell satisfactorily exhibits its functions to improve durability and chargeability of the toner and the shell removed does not adhere to a toner-regulating blade.

DESCRIPTION OF EMBODIMENTS (Toner)

A toner of the present invention is a toner having a core-shell structure containing: a core particle containing at least a binder resin, a releasing agent and a colorant; and a shell on a surface of the core particle.

The toner preferably has a structure composed of a core particle and protrusions, where the core particle contains a binder resin, a releasing agent and a colorant; and, if necessary, further contains other components, and the protrusions are formed by fine resin particles attached on a surface of the core particle. The toner having such a structure can suitably produced by the below-described dissolution suspension method.

Hereinafter, the core particle may be referred to as a core. The shell has protrusions and is formed by fine resin particles attached on a surface of the core particle. The fine resin particles themselves or a collection of the fine resin particles may be referred to as the shell. Such a toner may be referred to as a core-shell toner.

In the toner of the present invention, the entirety or part of the surface of the core particle (core) may be covered with the protrusions, or the surface of the toner particle is covered with the fine resin particles so as to form a sea-island structure where the surface of the toner particle forms a sea and the fine resin particles form islands.

Preferably, the average of the lengths of the long sides of the protrusions is 0.1μm or more but less than 0.5 μm, the standard deviation of the lengths of the long sides of the protrusions is 0.2 or less, and the coverage rate of the protrusions is 30% to 90%.

The toner particles are observed under a scanning electron microscope (SEM), and the obtained SEM image can be used to measure the lengths of the long sides of the protrusions of each toner particle and a coverage rate of the protrusions on each toner particle.

Figure 7:
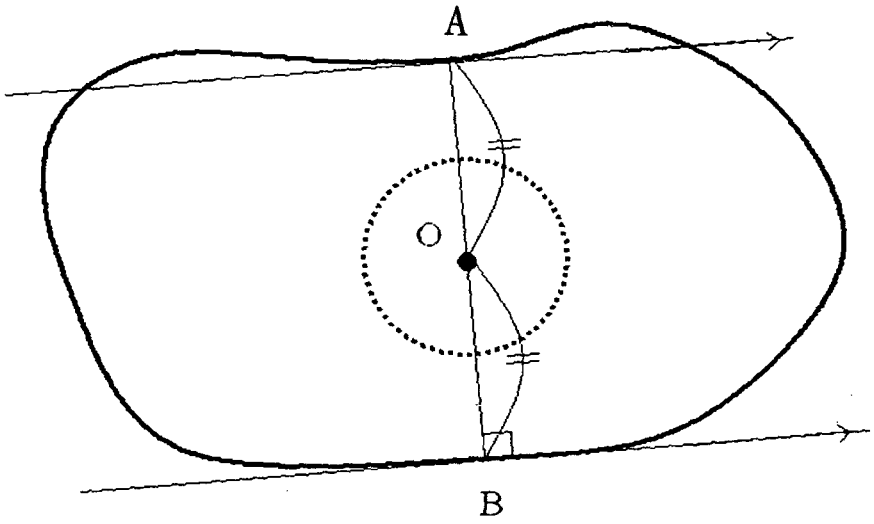
FIG. 7 is a sketch used for explaining calculation methods for long sides and a coverage rate of protrusions of a toner of the present invention.

With reference to FIG. 7, next will be described the calculation methods for long sides and a coverage rate of the protrusions.

<Coverage Rate>

The shortest length between two parallel straight lines in contact with the toner particle is determined, and the contact points are defined as A and B.

The area of a circle having as a center the center O of the line segment AB and having as a diameter the length of the line segment AO is calculated and the total area of the protrusions contained in the circle is calculated, to thereby obtain calculate a coverage rate of the protrusions on the toner particle (i.e., the total area of the protrusions/the area of the circle).

One hundred or more toner particles are calculated for coverage rate with the above method, and then the obtained coverage rates are averaged.

<Average of Lengths of Long Sides>

The average of the lengths of long sides is obtained by measuring the lengths of the long sides of 100 or more protrusions on 100 or more toner particles.

Notably, 100 toner particles are selected and the length of the long side of one protrusion is measured per one toner particle. The selected 100 toner particles were measured in this manner.

The area of the protrusions and the long side of the protrusions were measured with an image analysis-type particle size distribution analyzing software "MAC-VIEW" (product of Mountech Co., Ltd.).

The measuring methods for the length of the long side of the protrusion and the area of the protrusion are not particularly limited and may be appropriately selected depending on the intended purpose.

The average of the lengths of the long sides of the protrusions is preferably 0.1 μm to 0.5 μm, more preferably 0.1 μm to 0.3 μm.

When it is 0.5 μm or more, the protrusions on the surface become sparse and the effects of the surface modification cannot be obtained in some cases.

The standard deviation of the lengths of the long sides of the protrusions is preferably 0.2 or less, more preferably 0.1 or less.

When it is more than 0.2, the size of the protrusions on the surface becomes ununiform, which may lead to failures.

The coverage rate is preferably 30% to 90%, more preferably 40% to 80%, still more preferably 50% to 70%.

When the coverage rate is less than 30%, background smear occurs and heat resistance storageability becomes insufficient. When it is more than 90%, the low-temperature fixing property may degrade.

In the present invention, the toner gives a supernatant having a transmittance of 50% to 95%, preferably 60% to 95%, with respect to light having a wavelength of 800 nm, where the supernatant is formed after 3 g of the toner is added to 40 g of ion-exchange water containing 0.5% by mass of sodium dodecyl sulfate, followed by stirring for 90 min and by irradiating with ultrasonic waves of 20 kHz and 80 W for 5 min, and the resultant liquid containing the toner dispersed therein is centrifugated at 3,000 rpm for 5 min.

The above transmittance is an index indicating how hard it is for the fine resin particles to be removed from the core particle (core). The toner forming a supernatant having the above transmittance of 50% or higher is a toner where the shell is attached on the surface of the core particle more firmly than in the conventional core-shell toner. Since the shell is removed from the toner in a smaller amount, it is possible to make sure that the toner has high chargeability and durability.

When the transmittance is lower than 50%, the shell removed from the toner adheres to, for example, a toner-regulating blade, forming abnormal images. The removal of the shell (i.e., fine resin particles) from the toner occurs when the thickness of a toner layer is regulated with a blade in the developing device. The conditions for the irradiation of ultrasonic waves correspond to those for regulating the thickness of a toner layer. The supernatant contains not only the fine resin particles but also the colorant and the releasing agent. However, the light having a wavelength of 800 nm is influenced by the colorant and the releasing agent to less extent and thus is suitable for observing the absorption by the fine resin particles.

When the transmittance is higher than 95%, the removed shell cannot exhibit a spacer effect between toner particles. As a result, toner particles are in direct contact with each other and the external additives are embedded in the toner surfaces potentially degrade the toner.

Conventionally, it has been known a technique of adjusting how substances are removed from the toner surfaces under irradiation conditions (power) of ultrasonic waves at 50 W and 20 W. In the toner of the present invention where the fine resin particles are firmly attached, the correlation between the qualities such as adhesion and the amount of free substances could not be observed under irradiation conditions (power) of ultrasonic waves at 50 W and 20 W.

The transmittance can be measured in the following manner.

First, a 1-L polypropylene container is charged with 995 g of ion-exchange water from which solid impurities have been removed in advance.

Next, 5 g of "sodium dodecyl sulfate" (manufactured by KANTO KAGAKU K.K.) serving as a dispersing agent is added to the ion-exchange water, to thereby prepare a 0.5% by mass dispersion liquid.

Then, 40 g of the prepared dispersion liquid is weighed and mixed with 3 g of the toner, followed by stirring for 90 min. The resultant mixture is transferred to a 100-mL stainless cup (manufactured by TOP Co.) where it is irradiated with ultrasonic waves for 5 min using an ultrasonic wave irradiation device ("VCX-750," manufactured by Sonics & Materials, Inc.) the power of which has been set to 80 W.

Before irradiation, it is confirmed that the source of ultrasonic waves is well immersed in the dispersion liquid (at a depth of 1 cm or greater from the liquid surface).

The dispersion liquid is appropriately cooled so that the temperature thereof falls within the range of 10° C. to 40° C. during irradiation of ultrasonic waves.

The toner dispersion liquid (11 mL) after irradiation of ultrasonic waves is placed in a 15-mL centrifugal tube, which is centrifugated at 3,000 rpm for 5 min. The centrifugal apparatus used was "CN-1040" manufactured by HSIANGTAI Inc.

The supernatant after centrifugation is sampled in an amount of 1.6 mL from the upper part of the liquid surface. The sampled supernatant is set into the quartz cell of a UV-Vis photospectrometer (UV-2550, manufactured by Shimadzu Corporation) and measured for transmittance with respect to light having a wavelength of 800 nm.

In this measurement, a 0.5% by mass aqueous solution of sodium dodecyl sulfate is used as a reference. The transmittance of the 0.5% by mass aqueous solution of sodium dodecyl sulfate with respect to light having a wavelength of 800 nm is regarded as 100%.

<Dissolution Suspension Method>

One toner production method employing the dissolution suspension method is a method including: dissolving or dispersing, in an organic solvent, a toner composition containing at least a binder resin, a releasing agent, a colorant and optional other components to thereby a solution or dispersion liquid; dispersing the solution or dispersion liquid in an aqueous medium in the presence of a dispersing agent using a commonly-used stirrer, homomixer or homogenizer in such a manner as to obtain toner particles having an intended particle size distribution; and removing the organic solvent to obtain a toner slurry (toner base particles). The obtained toner base particles can be isolated through recovering by washing/filtrating and drying according to a known method. Furthermore, the obtained toner base particles are mixed with particles such as external additives, whereby toner particles can be obtained.

<<Binder Resin>>

The binder resin is not particularly limited as long as it can dissolve into a solvent in the dissolution-suspension method, and may be appropriately selected depending on the intended purpose. For example, resins which are conventionally used in a toner can be used.

Examples thereof include polyester resin, styrene-acrylic resin, polyol resin, vinyl resin, polyurethane resin, epoxy resin, polyamide resin, polyimide resin, silicon resin, phenol resin, melamine resin, urea resin, aniline resin, ionomer resin, and polycarbonate resin. These may be used alone or in combination. Among these, polyester resin is preferable, and non-crystalline polyester resin is particularly preferable from the viewpoint of fixability.

The non-crystalline polyester resin is not particularly limited and may be appropriately selected depending on the intended purpose. Preferable are isocyanate modified polyester resin and unmodified polyester resin.

—Isocyanate Modified Polyester Resin—

The isocyanate modified polyester resin is formed by introducing an isocyanate group into the ends of a polyester resin in order to attain a toner having good viscoelastic properties. During the toner production process, preferably, the isocyanate groups are allowed to react for elongation to thereby provide the formed toner with an appropriate crosslinked structure.

Example of the isocyanate modified polyester includes one obtained by reacting polyester which is a polycondensate of a polyol (1) and a polycarboxylic acid (2) and has active hydrogen groups with a polyisocyanate (3).

Examples of the active hydrogen groups contained in the polyester include hydroxyl groups (alcoholic hydroxyl groups and phenolic hydroxyl groups), amino groups, carboxyl groups, and mercapto groups. Among these, alcoholic hydroxyl groups are particularly preferred.

—Polyol—

Examples of the polyol (1) include a diol (1-1) and a trihydric or higher polyol (1-2), with the diol (1-1) alone or a mixture containing the diol (1-1) and a small amount of the trihydric or higher polyol (1-2) being preferred.

Examples of the diol (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); and adducts of the above-listed bisphenols with alkylene oxides (e.g., ethylene oxide, propylene oxide and butylene oxide). These may be used alone or in combination.

Among these, preferred are C2 to C12 alkylene glycols and adducts of bisphenols with alkylene oxides. More preferred are adducts of bisphenols with alkylene oxides, and a combinations of adducts of bisphenols with alkylene oxides and C2 to C12 alkylene glycols.

Examples of the trihydric or higher polyol (1-2) include trihydric to octahydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and adducts of the above trihydric or higher polyphenols with alkylene oxide. These may be used alone or in combination.

—Polycarboxylic Acid—

Examples of the polycarboxylic acid (2) include dicarboxylic acids (2-1) and trivalent or higher polycarboxylic acids (2-2), with the dicarboxylic acids (2-1) alone or a mixture containing the dicarboxylic acids (2-1) and a small amount of the trivalent or higher polycarboxylic acids (2-2) being preferred.

Examples of the dicarboxylic acid (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acid). These may be used alone or in combination. Among these, preferred are C4 to C20 alkenylenedicarboxylic acids and C8 to C20 aromatic dicarboxylic acids.

Examples of the trivalent or higher polycarboxylic acid (2-2) include C9 to C20 aromatic polycarboxylic acids (e.g., trimellitic acid and pyromellitic acid). Notably, the polycarboxylic acids (2) may be reacted with polyols (1) in the form of acid anhydrides or lower alkyl esters (e.g., methyl ester, ethyl ester and isopropyl ester) thereof.

The ratio between the polyol (1) and the polycarboxylic acid (2) is preferably 2/1 to 1/1, more preferably 1.5/1 to 1/1, further preferably 1.3/1 to 1.02/1, in terms of the equivalent ratio [OH]/[COOH] of the hydroxyl group [OH] to the carboxyl group [COOH].

—Polyisocyanate—

Examples of the polyisocyanate (3) include aliphatic polyisocyanates (e.g., tetramethylene diisocyanate, hexamethylene diisocyanate, 2,6-diisocyanate methyl caproate); alicyclic polyisocyanates (e.g., isophorone diisocyanate, cyclohexylmethane diisocyanate); aromatic diisocyanates (e.g., tolylene diisocyanate, diphenylmethane diisocyanate); aromatic aliphatic diisocyanates (e.g., $\alpha,\alpha,\alpha',\alpha'$-tetramethyl xylylene diisocyanate); isocyanurates; blocked products of the polyisocyanates with, for example, phenol derivatives, oxime, or caprolactam; or a combination of two or more thereof.

The ratio of the polyisocyanate (3) is preferably from 5/1 to 1/1, more preferably from 4/1 to 1.2/1, and further preferably from 2.5/1 to 1.5/1, in terms of the equivalent ratio [NCO]/[OH] of the isocyanate group [NCO] to the hydroxyl group of the polyester having hydroxyl groups (OH). If the value of NCO/OH is more than 5, residual polyisocyanate compounds may have negative effect on chargeability of a toner.

—Elongation Agent—

Amines (B) can be used as an elongation agent in order to elongate the isocyanate modified polyester.

Examples of the amines (B) include diamines (B1), trivalent or higher polyamines (B2), aminoalcohols (B3), aminomercaptans (B4), amino acids (B5) and amino-blocked compounds (B6) obtained by blocking an amino group of B1 to B5. These may be used alone or in combination.

Examples of the diamine (B1) include aromatic diamines (e.g., phenylene diamine, diethyltoluene diamine, 4,4'-diaminodiphenylmethane, tetrafluoro-p-xylylenediamine and tetrafluoro-p-phenylenediamine); alicyclic diamines (e.g., 4,4'-diamino-3,3'-dimethyldicyclohexylmethane, diaminecyclohexane and isophorondiamine); and aliphatic diamines (e.g., ethylenediamine, tetramethylenediamine, hexamethylenediamine, dodecafluorohexylenediamine and tetracosafluorododecylenediamine).

Examples of the trivalent or higher polyamine (B2) include diethylenetriamine and triethylenetetramine.

Examples of the aminoalcohol (B3) include ethanolamine and hydroxyethylaniline.

Examples of the aminomercaptan (B4) include aminoethylmercaptan and aminopropylmercaptan.

Examples of the amino acid (B5) include aminopropionic acid and aminocaproic acid.

Examples of the amino-blocked compound (B6) obtained by blocking an amino group of B1 to B5 include oxazolidine compounds and ketimine compounds derived from the amines B1 to B5 and ketones (e.g., acetone, methyl ethyl ketone and methyl isobutyl ketone).

Among these amines (B), preferred are B1 and a mixture containing B1 and a small amount of B2.

The ratio of the amine (B) is preferably 1/2 to 2/1, more preferably 1.5/1 to 1/1.5, further preferably 1.2/1 to 1/1.2, in terms of the equivalent ratio [NCO]/[NHx] of the isocyanate group in the isocyanate modified polyester [NCO] to the amino group in the amines (B) [NHx]. If the value of [NCO]/[NHx] is greater than 2 or less than ½, the isocyanate modified polyester may not sufficiently elongate in some cases. Accordingly, the intended viscoelasticity may not be obtained.

The above isocyanate modified polyesters may be used alone. However, when one or more types of the linear isocyanate modified polyesters are used in combination with one or more types of the branched isocyanate modified polyesters, the viscoelasticity of the formed toner can be designed in a preferable manner. In order to allow the toner to uniformly have crosslinked structures each having sufficiently distant crosslinking points, particularly preferably, a branched isocyanate modified polyester is designed to have a relatively low molecular weight and is used in combination with a linear isocyanate modified polyester.

Designing the isocyanate modified polyester to have a long molecular chain may cause degradation in thermal characteristics of the formed toner. One possible reason for this is as follows. Specifically, such a long molecular chain is shrunk in the form of random coil in an oil phase of the toner production process, and the crosslinked structures are locally formed or the reaction of the isocyanate groups is completed in the molecule thereof, resulting in that the formed toner cannot uniformly have the crosslinked structures throughout the toner.

—Unmodified Polyester Resin—

In the present invention, polyester which is not modified with isocyanate (unmodified polyester resin) can be used in combination with the isocyanate modified polyester.

The unmodified polyester resin allows viscoelasticity of the toner to be easily set.

Examples thereof include polycondensates of the polyols (1) and the polycarboxylic acids (2).

—Crystalline Polyester Resin—

The toner of the present invention can contain crystalline polyester resin for improving low-temperature fixability.

The crystalline polyester resin can be obtained by polycondensing a polyol with a polycarboxylic acid.

The polyol is not particularly limited and may be appropriately selected depending on the intended purpose, but aliphatic diols are preferable.

Examples of the aliphatic diol include ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, and 1,4-butenediol. Among these, 1,4-butanediol, 1,6-hexanediol, and 1,8-octanediol are preferable, and 1,6-hexanediol is particularly preferable.

Examples of the polycarboxylic acid include aromatic dicarboxylic acids (e.g., phthalic acid, isophthalic acid, and terephthalic acid), and C2 to C8 aliphatic carboxylic acid. Among these, aliphatic carboxylic acids are preferable from the viewpoint of high degree of crystallinity.

The amount of the crystalline polyester resin contained in the toner is preferably 3% by mass to 10% by mass. When it is less than 3% by mass, the crystalline polyester resin cannot improve the low-temperature fixability very much. When it is more than 10% by mass, the chargeability of the toner degrades to potentially cause scattering.

Notably, the crystalline polyester resin is distinguished from the non-crystalline polyester resin in terms of thermal characteristics. The crystalline polyester resin refers to, for example, a resin exhibiting a clear endothermic peak through DSC as can be seen in wax. The non-crystalline polyester resin exhibits a smooth curve attributed to glass transition.

<<Releasing Agent>>

The releasing agent is not particularly limited and may be appropriately selected depending on the intended purpose. Preferable are waxes.

The waxes are not particularly limited and may be appropriately selected depending on the intended purpose. Examples thereof include polyolefin waxes (e.g., polyethylene wax and polypropylene wax); long-chain hydrocarbons (e.g., paraffin waxes, Fischer-Tropsch waxes, and SASOL waxes); carbonyl group-containing waxes, synthetic ester waxes, and rice waxes. Among these, carbonyl group-containing waxes are preferred Examples of the carbonyl group-containing wax include polyalkanoic acid esters (e.g., carnauba waxes, montan waxes, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., tristearylamide trimellitate); and dialkyl ketones (e.g., distearyl ketone). These may be used alone or in combination.

Among these, preferable are at least one selected from paraffin waxes, synthetic ester waxes, polyolefin waxes, carnauba waxes, and rice waxes from the viewpoint of low polarity, low melt viscosity, and excellent releasing property. Particularly preferable are paraffin waxes and Fischer-Tropsch waxes.

The amount of the releasing agent contained in the toner is not particularly limited and may be appropriately selected depending on the intended purpose, but is preferably 4.0% by mass to 8.0% by mass. When it is less than 4.0% by mass, a sufficient amount of the releasing agent insufficiently does not exude, which easily causes paper jam. When it is more than 8.0% by mass, the toner core particles are easier to contact the members, potentially cause problems such as OPC filming.

The releasing agent having low polarity easily dissolves in n-hexane. Thus, when the toner is immersed in n-hexane and then the amount of the releasing agent extracted from the toner surface is controlled, it is possible to provide a toner improved in releasability and free of contaminating the members.

The amount of the releasing agent extracted with hexane (amount of wax extracted) is preferably 10 mg/g to 25 mg/g, more preferably 13 mg/g to 22 mg/g. When it is less than 10 mg/g, the releasability of the toner becomes insufficient to easily cause paper jam. When it is more than 25 mg/g, the toner core particles are easier to contact the members, potentially cause problems such as OPC filming.

The amount of the releasing agent extracted with hexane can be adjusted by controlling, for example, the amount of the releasing agent added and the type or amount of the dispersing agent used.

The amount of the releasing agent extracted with hexane (amount of wax extracted) can be measured with the following method.

Specifically, 1.0 g of a toner is weighed in a 30-mL glass screw tube at a temperature of 25° C.±2° C. Then, 7 mL of n-hexane is added thereto and the resultant mixture is stirred with a roll mill at 120 rpm for 1 min. The obtained solution is filtrated through aspiration using a PTFE membrane filter having an opening of 1 μm.

The filtrate is dried at 40° C. for 24 hours and the mass of the filtrate after drying is measured. The obtained measurement is defined as the "amount of the extracted releasing agent."

The amount of the releasing agent extracted with hexane can be calculated by dividing the "amount of the extracted releasing agent" by 1 g ("amount of the extracted releasing agent" 1 g).

<<Colorant>>

The colorant is not particularly limited and may be appropriately selected depending on the intended purpose. Examples thereof include carbon black, aniline blue, calcoil blue, chromium yellow, ultramarine blue, DuPont oil red, quinoline yellow, methylene blue chloride, copper phthalocyanine, malachite green oxalate, lamp black, rose Bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. pigment yellow 74, C.I. solvent yellow 162, C.I. pigment yellow 180, C.I. pigment yellow 185, C.I. pigment blue 15:1 and C.I. pigment blue 15:3. These may be used alone or in combination.

The amount of the colorant relative to the amount of the toner is not particularly limited and may be appropriately selected depending on the intended purpose. However, preferable is 2 parts by mass to 15 parts by mass relative to 100 parts by mass of the binder resins.

The colorant is preferably used in a form of a master batch in which the colorant is dispersed in the binder resin in terms of dispersibility. The amount of the master batch to be contained may be any as long as the amount of the colorant is in the above range. The amount of the colorant in the master batch is preferably 20% by mass to 40% by mass.

<<Organic Solvent>>

The organic solvent preferably has a boiling point of less than 100° C., which allows it to be easily removed. The organic solvent is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone. These may be used alone or in combination.

<<Aqueous Medium>>

The aqueous medium may be water alone or a combination of water and a solvent compatible with water. The solvent compatible with water is not particularly limited and may be appropriately selected depending on the intended purpose. Examples thereof include alcohols such as methanol, isopropanol, and ethylene glycol; dimethyl formamide; tetrahydrofuran; cellosolves such as methyl cellosolve; lower ketones such as methylethylketone. These may be used alone or in combination.

The amount of aqueous medium used is preferably 50 parts by mass to 2,000 parts by mass, more preferably 100 parts by mass to 1,000 parts by mass relative to 100 parts by mass of the toner material. When the amount is less than 50 parts by mass, the dispersion status of the toner material may worsen. In addition, it is not economical to use the aqueous medium in amount of more than 2,000 parts by mass.

<<Dispersing Agent>>

Example of the dispersing agent includes an inorganic dispersing agent.

The inorganic dispersing agent is not particularly limited and may be appropriately selected depending on the intended purpose. Examples thereof include tricalcium phosphate, magnesium phosphate, aluminum phosphate, zinc phosphate, magnesium carbonate, calcium hydroxide, magnesium hydroxide, aluminum hydroxide, calcium metasilicate, calcium sulfate, barium sulfate, bentonite, alumina, calcium carbonate, titanium oxide, colloidal silica and hydroxyapatite. These may be used alone or in combination.

<<External Additive>>

Fine inorganic particles can be preferably used as the external additives that are used for aiding flowability, developability, and chargeability of the toner.

The primary particle diameters of the fine inorganic particles are preferably 5 nm to 2 μm, more preferably 5 nm to 500 nm. The specific surface area according to a BET method is preferably 20 $m^2/g$ to 500 $m^2/g$. The amount of the fine inorganic particles contained is preferably 0.01% by mass to 5% by mass, more preferably 0.01% by mass to 2.0% by mass relative to the amount of the toner.

The fine inorganic particles are not particularly limited and can be appropriately selected depending on the purpose. Examples thereof include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

Polymer fine particles can be used as the external additive. Examples thereof include polystyrenes obtained by soap-free emulsification polymerization, suspension polymerization, and dispersion polymerization; copolymers of methacrylic acid ester or acrylic acid ester; polycondensates such as silicone, benzoguanamine, and nylon; and polymer particles from thermosetting resins.

A combination of inorganic fine particles surface-treated with silicone oil (External additive A) and inorganic fine particles surface treated with an amino group-containing silane coupling agent (External additive B) is preferably used as the external additives.

—Inorganic Fine Particles Surface-Treated with Silicone Oil (External Additive A)—

Examples of the silicone oil include dimethylsilicone oil, methylphenylsilicone oil, chlorophenylsilicone oil, methylhydrogensilicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acrylic-modified silicone oil, methacrylic-modified silicone oil, and α-methylstyrene-modified silicone oil. These may be used alone or in combination.

In order for the external additive to supply silicone oil to a wide range of each toner particle for a long period of time, it is important that the external additive is not made to release. Measures to make it difficult for the external additive to be released are, for example, a measure to increase the adhesion power of the external additive to toner base particles and a measure to reduce the contact area of the toner particle with the member. Particularly in the former case, it is better that the external additive is in contact with the toner base particles. The surface area of the toner base particles is preferably larger in order that a certain amount of the external additive is made to attach on the toner base particles. As in the present invention, providing the surfaces of the toner base particles with protrusions having a uniform size can increase the surface area of the toner base particles while the effects of the surface modification can be satisfactorily obtained. As a result, it is possible to make the toner base particles bear an increased amount of the external additive. Also, provision of the protrusions can reduce the contact area between the toner and the members, making it possible to prevent the external additive from being released and obtain effects such as suppression of contamination of the members by the toner, improvement in transfer rate, suppression of cleaning failure, and prevention of aggregation between toner particles. As described above, remarkable effects can be obtained by using in combination the external additive treated with silicone oil and the toner base particles having protrusions with a uniform size.

—Inorganic Fine Particles Surface Treated with Amino Group-Containing Silane Coupling Agent (External Additive B)—

A method for hydrophobizing the fine inorganic particles include a method in which the fine inorganic particles are chemically treated with an organic silicon compound which can react with or be physically adsorbed to the fine inorganic particle. Preferable is a method in which the fine inorganic particles are oxidized by a halogenated metal compound in a vapor phase and then treated with an organic silicon compound.

Examples of the organic silicon compound used in the method for hydrophobizing the fine inorganic particles include hexamethylene disilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganosilylmercaptane, trimethylsilylmercaptane, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per one molecule and one hydroxy group bonded to Si atom at each terminal unit. These may be used alone or in combination.

Untreated fine inorganic particles can be hydrophobized using a nitrogen-containing silane coupling agent.

Examples of the nitrogen-containing silane coupling agent include aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, trimethoxysilyl-γ-propylbenzylamine, trimethoxysilyl-γ-propylpiperidine, trimethoxysilyl-γ-propylmorphorine, and trimethoxysilyl-γ-propylimidazole. These may be used alone or in combination.

Inorganic fine particles show high positive chargeability when treated with the nitrogen-containing silane coupling agent. When the inorganic fine particles hydrophobized with the nitrogen-containing silane coupling agent are transferred from the toner particles to the developer bearing member, the developer bearing member is covered with the inorganic fine particles. When the inorganic fine particles and the toner particles are frictionally charged, the toner particles can negative-charged strongly. In addition, the inorganic fine particles are constantly and gradually supplied from the toner particles, making it possible to stabilize the chargeability of the toner for a long period of time. One possible mean of obtaining this effect for a long period of time over a wide range of the toner particle, increasing the amount of the external additive. In this case, although the intended effect can be obtained initially and locally, it becomes easier for the external additive to be released, making it difficult to obtain the effect for a long period of time over a wide range of the toner particle. In order to make it difficult for the external additive to be released, it is preferable that the external additive is in contact with the toner particles. The surface area of the toner particles is preferably larger in order that a certain amount of the external additive is made to attach on the toner particles. As in the present invention, providing the toner surfaces with protrusions of the fine resin particles can increase the surface area of the toner particles, making it possible to make the toner particles bear an increased amount of the external additive. Also, reducing the contact surface between the toner and the members makes it possible to prevent the external additive from being released. As described above, remarkable effects can be obtained by using in combination the external additive treated with the nitrogen-containing silane coupling agent.

When the inorganic fine particles treated with the nitrogen-containing silane coupling agent are used as the external additive, the amount thereof is preferably 5% by mass to 30% by mass, more preferably 10% by mass to 20% by mass, relative to the total mass of the external additive. When it is less than 5% by mass, the inorganic fine particles treated with the nitrogen-containing silane coupling agent cannot exhibit their effects, which is not preferred. When it is more than 30% by mass, the positive chargeability derived from the external additive becomes high and thus the resultant toner does not work normally as an intended toner. For the same reasons, the amount of the inorganic fine particles treated with the nitrogen-containing silane coupling agent is preferably 0.1% by mass to 2.0% by mass, more preferably 0.5% by mass to 1.5% by mass, relative to the total mass of the toner.

<<Fine Resin Particles>>

The fine resin particles are not particularly limited and may be appropriately selected depending on the intended purpose, but are preferably vinyl fine resin particles.

The vinyl fine resin particles are made of a vinyl resin obtained through polymerization of a monomer mixture mainly containing as a monomer an aromatic compound having a vinyl polymerizable functional group. The toner surface preferably has an easily chargeable structure. In order for the toner surface to have such a structure, an aromatic compound having a vinyl polymerizable functional group which has electron orbitals where electrons can stably travel as can be seen in aromatic ring structures is preferably contained in the monomer mixture in an amount of 80% by mass or more, more preferably 80% by mass to 100% by mass, relative to the total amount of the monomer mixture. When the amount of the aromatic compound having a vinyl polymerizable functional group is less than 80% by mass, the obtained toner may be poor in chargeability.

Examples of the polymerizable functional group in the aromatic compound having a vinyl polymerizable functional group include a vinyl group, an isopropenyl group, an allyl group, an acryloyl group and a methacryloyl group.

Specific examples of the monomer include styrene, α-methylstyrene, 4-methylstyrene, 4-ethylstyrene, 4-tert-butylstyrene, 4-methoxystyrene, 4-ethoxystyrene, 4-carboxystyrene or metal salts thereof, 4-styrenesulfonic acid or metal salts thereof, 1-vinylnaphthalene, 2-vinylnaphthalene, allylbenzene, phenoxyalkylene glycol acrylate, phenoxyalkylene glycol methacrylate, phenoxypolyalkylene glycol acrylates and phenoxypolyalkylene glycol methacrylates. These may be used alone or in combination.

Among these, preferably, styrene is mainly used since it is easily available, and has excellent reactivity and high chargeability.

The vinyl resin used in the present invention preferably contains no acid monomer. When the acid monomer is used, the obtained vinyl fine resin particles themselves have high dispersion stability. Thus, when such vinyl fine resin particles are added to the dispersion liquid containing oil droplets dispersed in the aqueous phase, the vinyl fine resin particles are difficult to attach thereonto at ambient temperature. Alternatively, even when the vinyl fine resin particles have been attached thereonto, they tend to be exfoliated through the process of desolvation, washing, drying or external addition. On the other hand, the vinyl resin which contains no acid monomer allows the obtained toner to make less change in chargeability depending on the working environment.

Examples of an acid group in a compound having a vinyl polymerizable functional group and an acid group include a carboxylic acid group, a sulfonic acid group and a phosphonic acid group.

Examples of the compound having the vinyl polymerizable functional group and the acid group include carboxyl group-containing vinyl monomers or salts thereof (e.g., (meth) acrylic acid, maleic acid, maleic anhydride, monoalkyl maleates, fumaric acid, monoalkyl fumarates, crotonic acid, itaconic acid, monoalkyl itaconate, glycol monoether itaconate, citraconic acid, monoalkyl citraconates and cinnamic acid), sulfonic acid group-containing vinyl monomers, vinyl-based sulfuric acid monoesters or salts thereof, and phosphoric acid group-containing vinyl monomers or salts thereof. These may be used alone or in combination. Among these, particularly preferred are (meth)acrylic acid, maleic acid, maleic anhydride, monoalkyl maleates, fumaric acid and monoalkyl fumarates.

Examples of a compound having the vinyl polymerizable functional group and an ester group include vinyl acetate, vinyl butyrate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl(meth)acrylate, vinyl methoxyacetate, vinyl benzoate, ethyl-α-ethoxyacrylate, alkyl(meth)acrylates with an alkyl group having 1 to 50 carbon atoms, dialkyl fumarates in which two alkyl groups are C2 to C8 straight, branched, or alicyclic alkyl groups, dialkyl maleates in which two alkyl groups are C2 to C8 straight, branched, or alicyclic alkyl groups, poly(meth)allyloxyalkanes, vinyl monomers having a polyalkylene glycol chain, poly(meth)acrylates, vinyl(alkyl)ethers, vinyl ketones, vinyl sulfones.

Examples of the alkyl(meth)acrylates with an alkyl group having 1 to 50 carbon atoms include methyl(meth)acrylate, ethyl(meth)acrylate, propyl(meth)acrylate, butyl(meth)acrylate, 2-ethylhexyl(meth)acrylate, dodecyl(meth)acrylate, hexadecyl(meth)acrylate, heptadecyl(meth)acrylate, and eicosyl(meth)acrylate.

Examples of the poly(meth)allyloxyalkanes include diallyloxyethane, triallyloxyethane, tetraallyloxyethane, tetraallyloxypropane, tetraallyloxybutane, and tetramethallyloxyethane.

Examples of the vinyl monomers having a polyalkylene glycol chain include polyethylene glycol (molecular weight: 300) mono(meth)acrylate, polypropylene glycol (molecular weight: 500) monoacrylate, methyl alcohol ethylene oxide 10 mol adduct (meth)acrylate, and lauryl alcohol ethylene oxide 30 mol adduct (meth)acrylate.

Examples of the poly(meth)acrylates include (meth)acrylates of polyhydric alcohols such as ethylene glycol di(meth) acrylate, propylene glycol di(meth)acrylate, neopentyl glycol di(meth)acrylate, trimethylolpropane tri(meth)acrylate, and polyethylene glycol di(meth)acrylate.

Examples of the vinyl(alkyl)ethers include vinyl methyl ether, vinyl ethyl ether, vinyl propyl ether, vinyl butyl ether, vinyl-2-ethylhexyl ether, vinyl phenyl ether, vinyl-2-methoxyethyl ether, methoxybutadiene, vinyl-2-butoxyethyl ether, 3,4-dihydro-1,2-pyran, 2-butoxy-2'-vinyloxydiethyl ether, vinyl-2-ethylmercaptoethyl ether, acetoxystyrene, and phenoxystyrene.

Examples of the vinyl ketones include vinyl methyl ketone, vinyl ethyl ketone, and vinyl phenyl ketone.

Examples of the vinyl sulfones include divinyl sulfide, p-vinyl diphenyl sulfide, vinyl ethyl sulfide, vinyl ethyl sulfone, divinyl sulfone, and divinyl sulfoxide.

A method for obtaining the vinyl fine resin particles is not particularly limited and may be appropriately selected depending on the intended purpose. Examples thereof include the following methods (a) to (f):

(a) a method in which a monomer mixture is polymerized by a suspension polymerization method, an emulsification polymerization method, a seed polymerization method or a dispersion polymerization method, to thereby produce a dispersion liquid of vinyl fine resin particles;

(b) a method in which a monomer mixture is polymerized, and then the obtained resin is pulverized using a fine pulverizer such as a mechanically rotating type fine pulverizer or a jetting type fine pulverizer, followed by classifying, to thereby produce fine resin particles;

(c) a method in which a monomer mixture is polymerized, and then the obtained resin is dissolved in a solvent, followed by spraying of the resultant resin solution, to thereby produce fine resin particles;

(d) a method in which a monomer mixture is polymerized, the obtained resin is dissolved in a solvent, another solvent is added to the resultant resin solution to precipitate fine resin particles, and then the solvent is removed to thereby produce fine resin particles; or a method in which a monomer mixture is polymerized, the obtained resin is dissolved in a solvent with heating, the resultant resin solution is cooled to precipitate fine resin particles, and then the solvent is removed to thereby produce fine resin particles;

(e) a method in which a monomer mixture is polymerized, the obtained resin is dissolved in a solvent, the resultant resin solution is dispersed in an aqueous medium in the presence of an appropriate dispersing agent, and then the solvent is removed from the resultant dispersion liquid, for example, with heating or reduced pressure; and (f) a method in which a monomer mixture is polymerized, the obtained resin is dissolved in a solvent, an appropriate emulsifying agent is dissolved in the resultant resin solution, followed by phase-transfer emulsification with the addition of water.

Among these, method (a) is preferably employed, since vinyl fine resin particles can be produced as a dispersion liquid, which is easy to use for the next step.

In the polymerization reaction of method (a), preferably, (i) a dispersion stabilizer is added to an aqueous medium, (ii) a monomer capable of imparting dispersion stability to the fine resin particles obtained through polymerization (i.e., a reactive emulsifier) is added to the monomer mixture to be polymerized, or the above (i) and (ii) are performed in combination, to thereby impart dispersion stability to the obtained vinyl fine resin particles. When neither the dispersion stabilizer nor the reactive emulsifier is used, the particles cannot be maintained in a dispersion state whereby the vinyl resin cannot be obtained as fine particles, the obtained fine resin particles are poor in dispersion stability whereby they are poor in storage stability resulting in aggregation during storage, or the particles are degraded in dispersion stability at the below-described attachment step of fine resin particles whereby the core particles easily aggregate or combined together resulting in that the finally obtained colored resin particles is degraded in evenness of, for example, particle diameter, shape, and surface, which is not preferred.

Examples the dispersion stabilizer include a surfactant and an inorganic dispersing agent.

The surfactant is not particularly limited and may be appropriately selected depending on the intended purpose.

Examples thereof include anionic surfactants such as alkylbenzenesulfonic acid salts, α-olefin sulfonic acid salts and phosphoric acid esters; cationic surfactants such as amine salts type cationic surfactants (e.g., alkyl amine salts, aminoalcohol fatty acid derivatives, polyamine fatty acid derivatives and imidazoline), and quaternary ammonium salts type cationic surfactants (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine.

The inorganic dispersing agent is not particularly limited and may be appropriately selected depending on the intended purpose. Examples thereof include tricalcium phosphate, calcium carbonate, titanium oxide, colloidal silica and hydroxyapatite.

When the weight average molecular weight of the vinyl fine resin particles forming the shell is lower than 5,000, the physical strength of the vinyl fine resin particles is low so that the vinyl fine resin particles are brittle. As a result, the toner surface is easily changed to cause, for example, considerable change in chargeability, contamination such as deposition on the surrounding members, and problems about qualities accompanied thereby, which is not preferred. When the weight average molecular weight of the vinyl fine resin particles forming the shell is higher than 400,000, the fixing performance may be degraded. Considering fixability and durability, the weight average molecular weight of the vinyl fine resin particles forming the shell is 10,000 to 50,000.

Whether or not the vinyl fine resin particles are attached onto the surfaces of the core particles can be confirmed through observation under a scanning electron microscope (SEM).

The amount of the fine resin particles contained is not particularly limited and may be appropriately selected depending on the intended purpose. However, the amount is preferably 3 parts by mass to 15 parts by mass, more preferably 3 parts by mass to 10 parts by mass, relative to 100 parts by mass of the core particles.

When the amount of the fine resin particles contained is less than 3 parts by mass, background smear on a photoconductor occurs. When it is more than 15 parts by mass, there may be problems about qualities such as degradation in chargeability of the toner which causes contamination of the photoconductor and adhesion to the regulating blade.

<<Other Components>>

The other components are not particularly limited and may be appropriately selected depending on the intended purpose. Examples thereof include a charge controlling agent, a flowability improver, a cleaning improver, and a magnetic material.

<Method for Producing Toner>

The preferable method for producing the toner includes a dissolution suspension method.

The dissolution suspension method includes a preparation step of oil phase, a production step of toner base particles, and an attachment step of fine resin particles; and if necessary, further includes other steps.

<<Preparation Step of Oil Phase>>

The oil phase in which materials such as a binder resin, a releasing agent, and a colorant are dissolved or dispersed in the organic solvent may be prepared in the following manner. Specifically, the materials such as the binder resin, the releasing agent, and the colorant are gradually added to the organic solvent under stirring so that these materials are dissolved or dispersed therein. Notably, when a pigment is used as the colorant and/or when materials such as the releasing agent used are poorly dissolvable to the organic solvent, the particles of these materials may be micronized before the addition to the organic solvent.

In still another means, when dispersing the materials melted at a temperature lower than the boiling point of the organic solvent, they are dissolved in the organic solvent with heating and stirring together with the dispersoids, if necessary in the presence of a dispersion aid; and the resultant solution is cooled with stirring or shearing so that the dissolved materials are crystallized, to thereby produce microcrystals of the dispersoids.

After the colorant and the releasing agent, dispersed with any of the above means, have been dissolved or dispersed in the organic solvent together with a binder resin, the resultant solution or dispersion may be further dispersed. The dispersion may be performed using a known disperser such as a bead mill or a disc mill.

<<Production Step of Toner Base Particle>>

In the present invention, the term "toner base particle" means particles in which fine resin particles are attached to core particles.

Example of a method for dispersing the above-obtained oil phase in a aqueous medium which contains a surfactant to thereby produce a dispersion liquid in which core particles composed of the oil phase are dispersed is not particularly limited and may be appropriately selected depending on the intended purpose Examples thereof include a method using a disperser a such as a low-shear disperser, a high-shear disperser, a friction disperser, a high-pressure jet disperser, and a ultrasonic disperser.

In order to adjust the particle diameter of the dispersion to between 2 μm and 20 μm, the high-shear disperser is preferable. When the high-shear disperser is used, the rotational speed is not particularly limited and may be appropriately selected depending on the intended purpose, but it is preferably from 1,000 rpm to 30,000 rpm, more preferably from 5,000 rpm to 20,000 rpm.

The dispersion time is not particularly limited and may be appropriately selected depending on the intended purpose, but it is preferably 0.1 rain to 5 min in the case of a batch method. When the dispersion time exceeds 5 min, unfavorable small particles may remain and excessive dispersion may be performed to make the dispersion system unstable, potentially forming aggregates and coarse particles.

The dispersion temperature is preferably from 0° C. to 40° C., more preferably from 10° C. to 30° C. When the dispersion temperature exceeds 40° C., molecular movements are excited to degrade dispersion stability, easily forming aggregates and coarse particles. Whereas when the dispersion temperature is lower than 0° C., the dispersion is increased in viscosity to require elevated energy for dispersion, leading to a drop in production efficiency.

The surfactant usable may be the same as those mentioned in the above-described production method of the fine resin particles. In order to efficiently disperse the oil droplets containing the solvent, the surfactant used is preferably a disulfonic acid salt having a relatively high HLB.

The concentration of the surfactant contained in the aqueous medium is preferably 1% by mass to 10% by mass, more preferably 2% by mass to 8% by mass, further preferably 3% by mass to 7% by mass. When the concentration exceeds 10% by mass, each oil droplet becomes too small and also has a reverse micellar structure. Thus, the dispersion stability is degraded due to the surfactant added in such an amount, to thereby easily form coarse oil droplets. Whereas when the concentration is lower than 1% by mass, the oil droplets cannot be stably dispersed to thereby form coarse oil droplets. Needless to say, both cases are not preferred.

<<Attachment Step of Fine Resin Particle>>

The obtained core particle dispersion liquid can contain stable liquid droplets of the core particles as long as the dispersion liquid is being stirred. Thus, for attaching the vinyl fine resin particles onto the core particles, the vinyl fine resin particle dispersion liquid is added to the core particle dispersion liquid while stirring. The period for which the vinyl fine resin particle dispersion liquid is added is preferably 30 sec or longer. When it is added for 30 sec or shorter, the dispersion system drastically changes to form aggregated particles. In addition, the vinyl fine resin particles are ununiformly attached onto the core particles, which is not preferred. Meanwhile, adding the vinyl fine resin particle dispersion liquid over an unnecessarily long period of time (e.g., 60 min or longer) is not preferred from the viewpoint of lowering production efficiency.

Before added to the core particle dispersion liquid, the vinyl fine resin particle dispersion liquid may be appropriately diluted or concentrated so as to have a desired concentration. The concentration of the vinyl fine resin particles in the vinyl fine resin particle dispersion liquid is preferably 5% by mass to 30% by mass, more preferably 8% by mass to 20% by mass. When the concentration is less than 5% by mass, the concentration of the organic solvent greatly changes upon addition of the vinyl fine resin particle dispersion liquid to thereby lead to insufficient attachment of the fine resin particles, which is not preferred. Also, when the concentration exceeds 30% by mass, the fine resin particles tend to be localized in the core particle dispersion liquid, resulting in that the fine resin particles are ununiformly attached onto the core particles, which is not preferred.

The vinyl fine resin particle dispersion liquid to be added may be a dispersion liquid prepared by mixing a dispersion liquid of low-molecular-weight fine resin particles with a dispersion liquid of high-molecular-weight fine resin particles. Preferably, a dispersion liquid of low-molecular-weight fine resin particles is first added and then 5 min to 60 min later, a dispersion liquid of high-molecular-weight fine resin particles is added. The reason why these dispersion liquids may be mixed together before addition is as follows. The low-molecular-weight fine resin particles first form the shell on the surfaces of the core particles containing a solvent, since they have higher compatibility to the core particles, and then the high-molecular-weight fine resin particles form the shell on the surfaces of the core particles after the low-molecular-weight fine resin particles has formed the shell.

The following may explain the reason why the vinyl fine resin particles are sufficiently firmly attached onto the core particles when using the attachment step of the fine resin particles. Specifically, when the vinyl fine resin particles are attached onto the liquid droplets of the core particles, the core particles can freely deform to sufficiently form contact surfaces with the vinyl fine resin particles and the vinyl fine resin particles are swelled with or dissolved in the organic solvent to make it easier for the vinyl fine resin particles to adhere to the binder resin in the core particles. Therefore, in this state, the organic solvent must exist in the system in a sufficiently large amount. Specifically, in the core particle dispersion liquid, the amount of the organic solvent is preferably 50 parts by mass to 150 parts by mass, more preferably 70 parts by mass to 125 parts by mass, relative to 100 parts by mass of the solid matter (e.g., binder resins, colorants, releasing agents and, if necessary, charge controlling agents). When the amount of the organic solvent exceeds 150 parts by mass, the amount of the colored resin particles obtained through one production process is reduced, resulting in low production efficiency. Also, a large amount of the organic solvent impairs dispersion stability, making it difficult to attain stable production, which is not preferred.

The temperature at which the vinyl fine resin particles are attached onto the core particles is preferably 10° C. to 60° C., more preferably 20° C. to 45° C. When the temperature exceeds 60° C., required energy for production is elevated to increase environmental loading, and the presence of vinyl fine resin particles having a low acid value on the surfaces of liquid droplets makes the dispersion system to be unstable to thereby potentially form coarse particles. Meanwhile, when the temperature is less than 10° C., the dispersion is increased in viscosity, leading to an insufficiently attachment of the fine resin particles. Needless to say, both cases are not preferred.

In addition, the fine resin particles may be mixed with the core particles under stirring to mechanically attach to and cover the core particles.

<<Other Steps>>

—Desolvation Step—

In one employable means for removing the organic solvent from the obtained toner base particle dispersion liquid, the entire system is gradually increased in temperature with stirring, to thereby completely evaporate off the organic solvent contained in the liquid droplets.

In another employable means, the obtained toner base particle dispersion liquid with stirring is sprayed toward a dry atmosphere, to thereby completely evaporate off the organic solvent contained in the liquid droplets. In still another employable means, the toner base particle dispersion liquid is reduced in pressure with stirring to evaporate off the organic solvent. The latter two means may be used in combination with the first means.

The dry atmosphere toward which the toner base particle dispersion liquid is sprayed generally uses heated gas (e.g., air, nitrogen, carbon dioxide and combustion gas), especially, gas flow heated to a temperature equal to or higher than the highest boiling point of the solvents used. Specifically, by removing the organic solvent even in a short time using, for example, a spray dryer, a belt dryer or a rotary kiln, the resultant product has satisfactory quality.

—Aging Step—

When a modified resin having an end isocyanate group is added, an aging step may be performed to proceed an elongation and/or crosslinking reaction of the isocyanate.

The aging time is preferably 10 min to 40 hours, more preferably 2 hours to 24 hours. The aging temperature is preferably 0° C. to 65° C., more preferably 35° C. to 50° C.

—Washing Step—

The dispersion liquid of the toner base particles obtained in the above-described manner contains subsidiary materials such as a surfactant and a dispersing agent as well as the toner base particles. Thus, the dispersion liquid is washed to separate the toner base particles from the subsidiary materials.

The washing method of the toner base particles is not particularly limited and may be appropriately selected depending on the intended purpose. Examples of thereof include a centrifugation method, a reduced-pressure filtration method and a filter press method. Any of the above methods forms a cake of the toner base particles. If the toner base particles are not sufficiently washed through only one washing process, the formed cake may be dispersed again in an aqueous solvent to form a slurry, which is repeatedly treated with any of the above methods to taken out the toner base particles. When a reduced-pressure filtration method or a filter press method is employed for washing, an aqueous solvent may be made to penetrate the cake to wash out the subsidiary materials contained in the toner base particles. The aqueous solvent used for washing may be water or a solvent mixture of water and an alcohol such as methanol or ethanol. Use of water is preferred from the viewpoint of reducing cost and environmental load caused by, for example, drainage treatment.

—Drying Step—

The washed toner base particles containing the aqueous medium in a large amount are dried to remove the aqueous medium, whereby only toner base particles can be obtained. Dryers used in the drying method are not particularly limited and may be appropriately selected depending on the intended purpose. Examples thereof include a spray dryer, a vacuum freezing dryer, a reduced-pressure dryer, a ventilation shelf dryer, a movable shelf dryer, a fluidized-bed-type dryer, a rotary dryer or a stirring-type dryer.

The toner base particles are preferably dried until the water content is finally decreased less than 1% by mass. Also, when the dried toner base particles flocculate to cause inconvenience in use, the flocculated particles may be separated from each other through beating using, for example, a jet mill, HENSCHEL MIXER, a super mixer, a coffee mill, an oster blender or a food processor.

—Step of Controlling the Amount of the Shell Removed—

The method of controlling the amount of the shell removed is, for example, a method where the shell is formed on the toner surfaces by mixing core-shell toner particles using a known mixer as a means of previously removing from the toner surfaces the shell attached thereto via a weak adhesive force and of firmly forming the shell on the core surface facing the blade; and a method where the reaction system during the toner production process (desolvation) is heated to around the glass transition temperature Tg of the toner to thereby improve the adhesiveness between the shell and the core. The method for previously removing the shell weakly attached to the core includes ultrasonically washing toner particles. The toner obtained through the above-described process can be in a state where the shell thereof is removed in a certain amount.

Controlling the amount of the removed shell prevents the effect of the shell at the regulating portion and ensures sufficient durability and chargeability. In addition, controlling the amount of the removed shell with the above method makes it possible that the shell serves as a spacer which prevents direct contact between toner particles, to thereby prevent embedment of the external additive.

—Step of Deforming the Shape of Protrusions—

In the step of deforming the shape of protrusions, a known mixer can be used to deform the protrusions to have a flat shape.

The mixer is not particularly limited and may be appropriately selected depending on the intended purpose. Examples thereof include a jet mill, HENSCHEL MIXER, a super mixer, a coffee mill, an oster blender and a food processor. Also, a heating treatment can be performed simultaneously in order to effectively deform the protrusions to have a flat shape. By doing so, a known surface modifying apparatus such as METEORAINBOW (manufactured by Nippon Pneumatic Mfg. Co. Ltd.) can be used.

—Step of Heating Toner Base Particles—

In the step of heating toner base particles, a known heating device and method can be used.

The heating device is not particularly limited and may be appropriately selected depending on the intended purpose, so long as it is a means of applying heat to the toner base particles. Examples thereof include a thermostat bath and a hot-water bath the temperature of which is adjusted constant.

—Step of Rewashing Toner Base Particles—

The step of rewashing the toner base particles is performed by drying the toner base particles once and redispersing them. Alternatively, this step may be performed in the course of the washing step. The device for irradiating ultrasonic waves used in this step is not particularly limited and may be appropriately selected depending on the intended purpose, so long as it can apply a certain amount of energy to the surfaces of the toner base particles.

—Step of Adding External Additives—

The dried toner powder thus obtained is mixed with other particles, such as external additives, charge control fine particles, or fluidizer fine particles, and the mixed powder may be subjected to mechanical impact to fix and fuse the other particles at the surface, and prevent the other particles from falling off the surface of the thus obtained composite particles. Specific ways to accomplish this include a method in which a mixture is subjected to an impact force by blades rotating at high speed, and a method in which a mixture is put into a high-speed gas flow and accelerated, so that the particles collide with each other, or composite particles collide with an appropriate collision plate. The apparatus used for this is not particularly limited and may be appropriately selected depending on the intended purpose. Examples thereof include ONG MILL (manufactured by Hosokawa Micron), a modified I TYPE MILL (manufactured by Nippon Pneumatic) in which the pressure of pulverization air is reduced, HYBRIDIZATION SYSTEM (manufactured by Nara Machine), KRYPTRON SYSTEM (manufactured by Kawasaki Heavy Industries), and an automatic mortar.

The toner of the present invention is not particularly limited and may be appropriately selected depending on the intended purpose in terms of its shape, size, and physical properties.

—Ratio of Intensity at 700 $cm^{-1}$ to Intensity at 828 $cm^{-1}$ Measured by ATR—

The arrangement of the materials near the toner surface can be observed based on the intensity ratio obtained by the FTIR-ATR method.

The toner exhibits a peak (at 828 $cm^{-1}$) Pa attributed to the binder resin and a peak (at 700 $cm^{-1}$) Pb attributed to the styrene-acryl resin forming the shell.

The intensity ratio (Pb/Pa) having a certain value can reflect the protrusions formed of the styrene-acryl resin, and is preferably 0.30 or higher, more preferably 0.30 to 0.70, further preferably 0.40 to 0.60.

The fine resin particles existing on the toner surface have an anti-adhesion effect under the NN environment (temperature: 23° C., humidity: 40% RH). However, when the intensity ratio (Pb/Pa) is adjusted to be 0.3 or higher, it is possible to ensure a satisfactory anti-adhesion effect even under the HH environment (temperature: 28° C., humidity: 80% RH). When it is higher than 0.7, the coverage rate of the fine resin particles on the toner surface becomes too large. As a result, the fine resin particles impede the fixability of the toner particles, and also the fine resin particles tend to be easily removed, which is not preferred.

The above intensity ratio (Pb/Pa) can be adjusted by, for example, controlling the amount of the shell added or performing ultrasonic washing during the washing.

—Ratio of Intensity at 475 $cm^{-1}$ to Intensity at 828 $cm^{-1}$ Measured by ATR—

The toner exhibits a peak (at 828 $cm^{-1}$) Pa attributed to the binder resin and a peak (at 475 $cm^{-1}$) Pc attributed to the silica external additive.

The intensity ratio (Pc/Pa) having a certain value can indicate that the protrusions formed of the styrene-acryl resin contain a certain amount of the external additive, and is preferably 0.15 or higher, more preferably 0.15 to 0.40, further preferably 0.20 to 0.35.

In the toner of the present invention where the fine resin particles are attached to the surface of the core particles, the toner base particles have concave and convex portions. Thus, it is necessary to optimize the amount of the external additive on the convex portions. Therefore, it is preferred that the intensity at 475 $cm^{-1}$ and the intensity at 828 $cm^{-1}$ be measured with ATR instead of the conventional fluorescent X rays to thereby measure the external additive only on the convex portions.

The above intensity ratio (Pc/Pa) can be adjusted by, for example, controlling the amount of the external additive to be added to the toner.

(Developer)

The toner of the present invention may be used as a one-component developer or a two-component developer. Preferably, the toner of the present invention is used as a one-component developer.

(Image Forming Apparatus and Image Forming Method)

An image forming method of the present invention includes:

a charging step which is a step of uniformly charging a surface of a latent image bearing member;

an exposing step which is a step of exposing the charged surface of the latent image bearing member to light, to thereby form a latent electrostatic image;

a developing step which is a step of supplying a toner to the latent electrostatic image formed on the surface of the latent image bearing member to form a visible image using a developing roller and a toner-regulating blade where the developing roller is configured to come into contact with the latent image bearing member and bear the toner on a surface thereof and the toner-regulating blade is configured to regulate an amount of the toner on the surface of the developing roller and form a thin layer of the toner;

a transfer step which is a step of transferring the visible image from the surface of the latent image bearing member surface onto a recording medium; and a fixing step which is a step of fixing the visible image on the recording medium;

and if necessary, further includes other steps.

The toner of the present invention is used as the toner in the image forming method.

Examples of the other steps include a cleaning step, a charge-eliminating step, a recycling step and a controlling step.

An image forming apparatus of the present invention includes:

a latent image bearing member configured to bear a latent image;

a charging unit configured to uniformly charge a surface of the latent image bearing member;

an exposing unit configured to expose the charged surface of the latent image bearing member to light based on image data, to thereby form a latent electrostatic image;

a developing unit including a developing roller and a toner-regulating blade and configured to supply a toner to the latent electrostatic image formed on the surface of the latent image bearing member to form a visible image using the developing roller and the toner-regulating blade where the developing roller is configured to come into contact with the latent image bearing member and bear the toner on a surface thereof and the toner-regulating blade is configured to regulate an amount of the toner on the surface of the developing roller and form a thin layer of the toner;

a transfer unit configured to transfer the visible image from the surface of the latent image bearing member onto a recording medium; and a fixing unit configured to fix the visible image on the recording medium;

and, if necessary, further includes other units.

The toner used in the mage forming apparatus is the toner the present invention.

The fixing unit is preferably a heat-fixing unit. The fixing unit is preferably has a fixing member that requires no oil application.

Examples of the other steps include a cleaning step, a charge-eliminating step, a recycling step and a controlling step.

Figure 1:
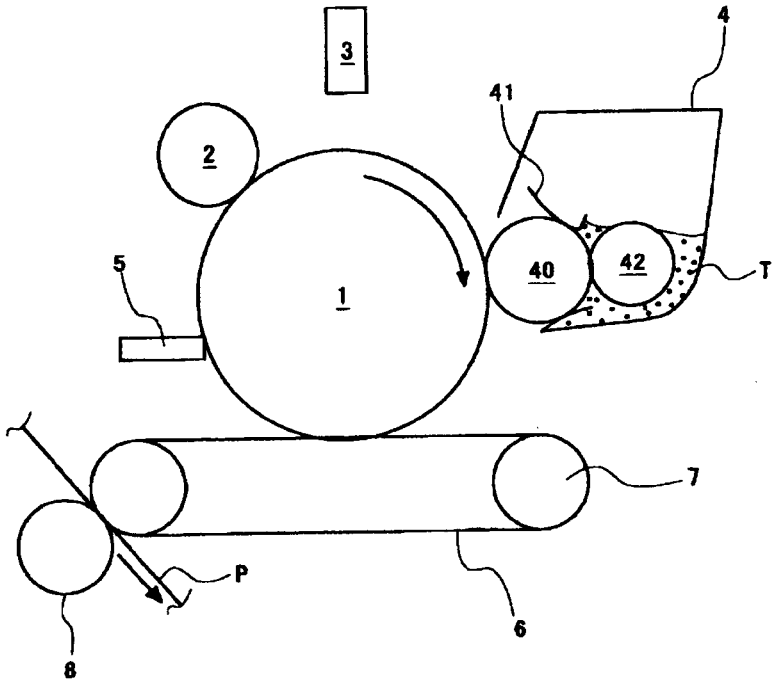
FIG. 1 is an explanatory view of essential parts of one exemplary image forming apparatus in which a toner of the present invention is used.

FIG. 1 illustrates one exemplary image forming apparatus of the present invention. This image forming apparatus contains, in an unillustrated main body casing, a latent image bearing member (1) rotated clockwise in FIG. 1. A charging device (2), an exposing device (3), a developing device (4) having the electrostatic image developing toner (T) of the present invention, a cleaning part (5), an intermediate transfer medium (6), a supporting roller (7), a transfer roller (8), an unillustrated charge-eliminating unit, and other members are provided around the latent image bearing member (1).

This image forming apparatus has an unillustrated paper-feeding cassette containing a plurality of recording paper sheets (P), which are an example of the recording medium. The recording paper sheets (P) in the paper-feeding cassette are fed one by one with an unillustrated paper-feeding roller to between the intermediate transfer medium (6) and the transfer roller (8) serving as a transfer unit. Before fed to therebetween, the recording paper sheet is retained with a pair of registration rollers so that it can be fed at a desired timing.

In this image forming apparatus, while being rotated clockwise in FIG. 1, the latent image bearing member (1) is uniformly charged with the charging device (2). Then, the latent image bearing member (1) is irradiated with laser beams modulated by image date from the exposing device (3), to thereby form a latent electrostatic image. The latent electrostatic image formed on the latent image bearing member (1) is developed with the toner using the developing device (4). Next, the toner image formed with the developing device (4) is transferred from the latent image bearing member (1) to the intermediate transfer medium (6) through application of transfer bias. Separately, the recording paper sheet (P) is fed to between the intermediate transfer medium (6) and the transfer roller (8), whereby the toner image is transferred onto the recording paper sheet (P). Moreover, the recording paper sheet (P) with the toner image is conveyed to an unillustrated fixing unit.

The fixing unit has a fixing roller which is heated to a predetermined fixing temperature with a built-in heater, and a press roller which is pressed against the fixing roller at a predetermined pressure. The fixing unit heats and presses the recording paper sheet conveyed from the transfer roller (8), to thereby fix the toner image on the recording paper sheet, which is then discharged to an unillustrated discharge tray.

In the image forming apparatus after the above-described recording process, the latent image bearing member (1), from which the toner image has been transferred by the transfer roller (8) onto the recording paper sheet, is further rotated to reach the cleaning part (5), where the toner remaining on the surface of the latent image bearing member (1) is scraped off. Then, the latent image bearing member (1) is charge-eliminated with an unillustrated charge-eliminating device. The image forming apparatus uniformly charges, with the charging device (2), the latent image bearing member (1) which has been charge-eliminated by the charge-eliminating device, and performs the next image formation in the same manner as described above.

Next will be described in detail the members suitably used in the image forming apparatus of the present invention.

The material, shape, structure and size of the latent image bearing member (1) are not particularly limited and may be appropriately selected from those known in the art. The latent image bearing member is suitably in the form of a drum or belt, and is, for example, an inorganic photoconductor made of, for example, amorphous silicon or selenium and an organic photoconductor made of, for example, polysilane or phthalopolymethine. Among these, an amorphous silicon photoconductor or an organic photoconductor is preferred since it has a long service life.

The latent electrostatic image can be formed on the latent image bearing member (1) with a latent electrostatic image-forming unit by, for example, imagewise exposing the surface of the latent image bearing member (1). The latent electrostatic image-forming unit contains at least the charging device (2) which charges the surface of the latent image bearing member (1) and the exposing device (3) which imagewise exposes the surface of the latent image bearing member (1).

The charging step can be performed by, for example, applying a voltage to the surface of the latent image bearing member (1) using the charging device (2).

The charging device (2) is not particularly limited and may be appropriately selected depending on the intended purpose. Examples thereof include contact-type chargers known per se having, for example, a conductive or semiconductive roller, a brush, a film and a rubber blade; and non-contact-type chargers utilizing colona discharge such as corotron and scorotron.

The charging device (2) may be a charging roller as well as a magnetic brush or a fur brush. The shape thereof may be suitably selected according to the specification or configuration of an electrophotographic apparatus. When a magnetic brush is used as the charging device, the magnetic brush is composed of a charging member of various ferrite particles such as Zn—Cu ferrite, a non-magnetic conductive sleeve to support the ferrite particles, and a magnetic roller included in the non-magnetic conductive sleeve. Also, the fur brush is, for example, a fur treated to be conductive with, for example, carbon, copper sulfide, a metal or a metal oxide, and the fur is coiled or mounted to a metal or a metal core which is treated to be conductive, thereby obtaining the charging device.

The charging device (2) is not limited to the aforementioned contact-type chargers. However, the contact-type chargers are preferably used from the viewpoint of reducing the amount of ozone generated from the charger in the image forming apparatus.

The exposing can be performed by, for example, imagewise exposing the latent image bearing member surface with the exposing device (3). The exposing device (3) is not particularly limited as long as it attains desired imagewise exposure to the surface of the latent image bearing member (1) charged with the charging device (2) and may be appropriately selected depending on the intended purpose. Examples thereof include various exposing devices such as a copy optical exposing device, a rod lens array exposing device, a laser optical exposing device and a liquid crystal shutter exposing device.

The developing can be performed by, for example, developing the latent electrostatic image with the toner of the present invention using the developing device (4). The developing device (4) is not particularly limited as long as it attains development using the toner of the present invention, and may be appropriately selected from known developing units. Preferred examples of the developing units include those having a developing device which has the toner of the present invention therein and which can apply the toner to the latent electrostatic image in a contact or non-contact manner.

The developing device (4) preferably has a developing roller (40) and a thin layer-forming member (41). Here, the developing roller (40) has a toner on the circumferential surface thereof and supplies the toner to the latent electrostatic image formed on the latent image bearing member (1) while being rotated together with the latent image bearing member (1) with which the developing roller (40) is in contact. The thin layer-forming member (41) comes into contact with the circumferential surface of the developing roller (40) to form a thin layer of the toner on the developing roller (40).

The developing roller (40) used is preferably a metal roller or elastic roller. The metal roller is not particularly limited and may be appropriately selected depending on the intended purpose. Examples thereof include an aluminum roller. By treating the metal roller through blast treatment, the developing roller (40) having a desired surface friction coefficient can be formed relatively easily. Specifically, an aluminum roller can be treated through glass bead blasting to roughen the roller surface to thereby attach an appropriate amount of toner onto the thus-obtained developing roller.

The elastic roller used is a roller coated with an elastic rubber layer. The roller is further provided thereon with a surface coat layer made of a material that is easily chargeable at the opposite polarity to that of the toner.

The hardness of the elastic roller is preferably set to be 85° or lower, more preferably 80° or lower in Asker C hardness, in order to prevent the toner from being degraded due to pressure concentration at a contact region between the elastic roller and the thin layer-forming member (41). When the hardness of the elastic roller is low, it becomes difficult to scrape off the fused matter on the thin layer-forming member, potentially leading to firm adhesion of the matter thereon. Thus, the Asker C hardness of the elastic roller is preferably set to be 60° or higher, more preferably 65° or higher.

The Asker C hardness of the elastic roller can be set by a known method such as a method by adjusting the crosslinking degree of the resin used.

The surface roughness Ra of the elastic roller is preferably 0.5 μm to 3.0 μm. When the surface roughness Ra thereof is less than 0.5 μm, it becomes difficult to scrape off the fused matter on the thin layer-forming member, potentially leading to firm adhesion of the matter thereon. In the case of the toner to which the fine resin particles are firmly attached as in the present invention, when the surface roughness Ra thereof is more than 3.0 μm, the reproducibility of thin lines may be degraded. One possible reason for this is as follows. Specifically, since there are fine resin particles having high chargeability on the surfaces of the toner particles, when a developing roller having a great Ra is used, the toner particles gather the concave portions of the surface of the developing roller so that they cause repulsion therebetween. The surface roughness Ra of the elastic roller can be adjusted by a known method such as a method where coarse particles adjusted in diameter are arranged near the surface of the elastic roller.

Also, since the developing roller (40) is applied a developing bias for forming an electrical field between the developing roller (40) and the latent image bearing member (1), the resistance of the elastic rubber layer is set to be $10^3\Omega$ to $10^{10}\Omega$. The developing roller (40) is rotated clockwise to convey the toner retained thereon to positions where the developing roller (40) faces the thin layer forming member (41) and the latent image bearing member (1).

The thin layer-forming member (41) is provided in a lower position than the contact region between the supply roller (42) and the developing roller (40). The thin layer-forming member (41) is a metal plate spring of stainless steel (SUS) or phosphor bronze, and its free end is brought into contact with the surface of the developing roller (40) at a press force of 10 N/m to 40 N/m. The thin layer-forming member (41) forms the toner passing thereunder into a thin layer by the press force and frictionally charges the toner. In addition, for aiding frictional charging, the thin layer forming member (41) is applied a regulation bias having a value offset in the same direction of the polarity of the toner against the developing bias.

The rubber elastic material forming the surface of the developing roller (40) is not particularly limited and may be appropriately selected depending on the intended purpose. Examples thereof include styrene-butadiene copolymer rubbers, acrylonitrile-butadiene copolymer rubbers, acrylic rubbers, epichlorohydrin rubbers, urethane rubbers, silicone rubbers and blends of two or more of them. Among these, particularly preferred are blend rubbers of epichlorohydrin rubbers and acrylonitrile-butadiene copolymer rubbers.

The developing roller (40) is produced by, for example, coating the circumference of a conductive shaft with the rubber elastic material. The conductive shaft is made, for example, of a metal such as stainless steel (SUS).

The transfer can be performed by, for example, charging the latent image bearing member (1) with a transfer roller. The transfer roller preferably has a primary transfer unit configured to transfer the toner image onto the intermediate transfer medium (6) to form a transfer image; and a secondary transfer unit (transfer roller (8)) configured to transfer the transfer image onto a recording paper sheet (P). Further preferably, toners of two or more colors, preferably, full color toners are used, the transfer roller has a primary transfer unit configured to transfer the toner images onto the intermediate transfer medium (6) to form a composite transfer image; and a secondary transfer unit configured to transfer the composite transfer image onto a recording paper sheet (P).

Notably, the intermediate transfer medium (6) is not particularly limited and may be appropriately selected from known transfer media. Preferred examples thereof include a transfer belt.

The transfer unit (the primary transfer unit or the secondary transfer unit) preferably has at least a transfer device which charge-separates the toner image from the latent image bearing member (1) toward the recording paper sheet (P). The number of the transfer unit may be one or more. Examples of the transfer unit include a corona transfer device using colona discharge, a transfer belt, a transfer roller, a pressure transfer roller and an adhesive transfer device.

Notably, typical examples of the recording paper sheet (P) include plain paper. The recording paper sheet, however, is not particularly limited as long as it can receive an unfixed image formed after development, and may be appropriately selected depending on the intended purpose. Further examples of the recording paper sheet employable include PET bases for use in OHP.

The fixing can be performed by, for example, fixing the toner image transferred onto the recording paper sheet (P) with a fixing unit. The fixing of the toner images of colors may be performed every time when each toner image is transferred onto the recording paper sheet (P) or at one time after the toner images of colors have been mutually superposed.

The fixing unit is not particularly limited and may be appropriately selected depending on the intended purpose. The fixing unit is preferably a known heat-press unit. Examples of the heat-press unit include a combination of a heat roller and a pres roller, and a combination of a heat roller, a pres roller and an endless belt. Notably, the heating temperature of the heat-press unit is preferably 80° C. to 200° C.

Figure 2:
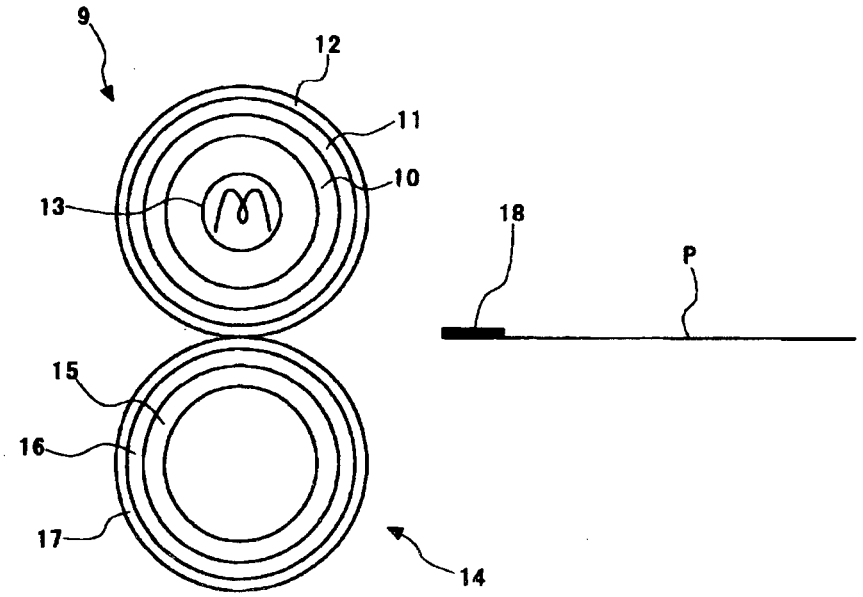
FIG. 2 is an explanatory view of the configuration of a fixing unit in an image forming apparatus in which a toner of the present invention is used.

The fixing device may be a soft roller-type fixing device having fluorine-containing surface layers as illustrated in FIG. 2. This fixing unit has a heat roller (9) and a press roller (14). The heat roller (9) has an aluminum core (10), an elastic material layer (11) of silicone rubber, PFA (tetrafluoroethylene-perfluoroalkyl vinyl ether copolymer) surface layer (12) and a heater (13), where the elastic material layer (11) and the PFA surface layer (12) are provided on the aluminum core (10) and the heater (13) is provided inside the aluminum core (10). The press roller (14) has an aluminum core (15), an elastic material layer (16) of silicone rubber and a PFA surface layer (17), where the elastic material layer (16) and the PFA surface layer (17) are provided on the aluminum core (15). Notably, the recording paper sheet (P) having an unfixed image (18) is fed as illustrated.

Notably, in the present invention, a known optical fixing device may be used in addition to or instead of the fixing unit depending on the intended purpose.

Charge elimination is preferably performed by, for example, applying a charge-eliminating bias to the latent image bearing member with a charge-eliminating unit. The charge-eliminating unit is not particularly limited as long as it can apply a charge-eliminating bias to the latent image bearing member, and may be appropriately selected from known charge-eliminating devices. Preferred example thereof includes a charge-eliminating lamp.

Cleaning is preferably performed by, for example, removing the toner remaining on the latent image bearing member with a cleaning unit. The cleaning unit is not particularly limited as long as it can remove the toner remaining on the latent image bearing member, and may be appropriately selected from known cleaners. Preferred examples thereof include a magnetic blush cleaner, an electrostatic brush cleaner, a magnetic roller cleaner, a blade cleaner, a brush cleaner and a web cleaner.

Recycling is preferably performed by, for example, conveying the toner having been removed by the cleaning unit to the developing unit with a recycling unit. The recycling unit is not particularly limited and may be any known conveying unit.

Controlling is preferably performed by, for example, controlling each unit with a controlling unit. The controlling unit is not particularly limited as long as it can control each unit, and may be appropriately selected depending on the intended purpose. Examples thereof include a sequencer and a computer.

The image forming apparatus, image forming method or process cartridge of the present invention uses the latent electrostatic image developing toner excellent in fixing property and involving no degradation (e.g., cracks) due to stress in the developing process, and thus can provide good images.

<Multi-Color Image Forming Apparatus>

Figure 3:
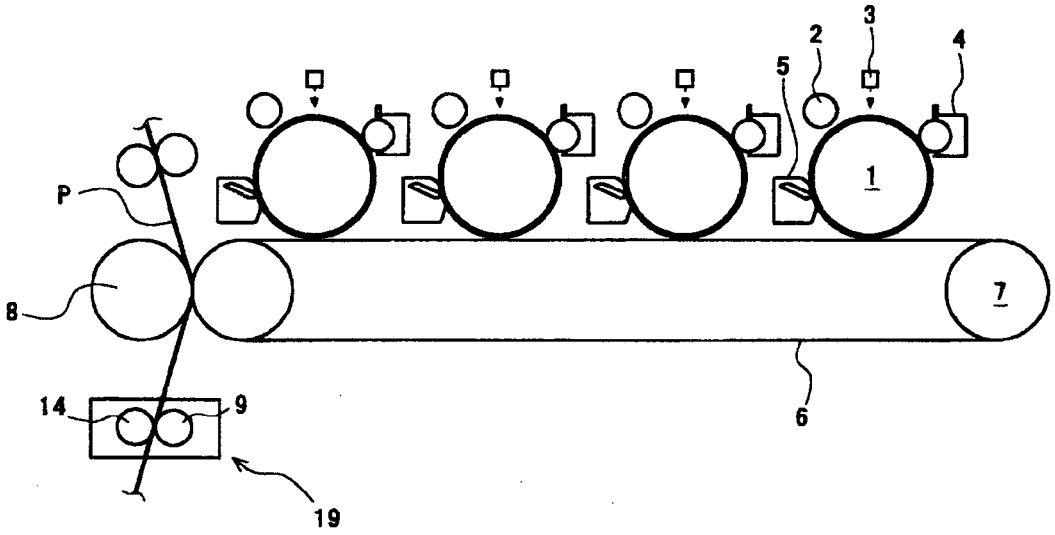
FIG. 3 is an explanatory view of another image forming apparatus in which a toner of the present invention is used.

FIG. 3 is a schematic view of an example of a multi-color image forming apparatus to which the present invention is applied. The multi-color image forming apparatus illustrated in FIG. 3 is a tandem-type full color image forming apparatus.

The image forming apparatus of FIG. 3 contains, in an unillustrated main body casing, latent image bearing members (1) rotated clockwise in FIG. 3. A charging device (2), an exposing device (3), a developing device (4), an intermediate transfer medium (6), a supporting roller (7), a transfer roller (8), and other members are provided around the latent image bearing member (1). This image forming apparatus has an unillustrated paper-feeding cassette containing a plurality of recording paper sheets. The recording paper sheets (P) in the paper-feeding cassette are fed one by one with an unillustrated paper-feeding roller to between the intermediate transfer medium (6) and the transfer roller (8), followed by fixing with a fixing unit (19). Before fed to therebetween, the recording paper sheet is retained with a pair of registration rollers so that it can be fed at a desired timing.

In this image forming apparatus, while being rotated clockwise in FIG. 3, each of the latent image bearing members (1) is uniformly charged with the corresponding charging device (2). Then, the latent image bearing member (1) is irradiated with laser beams modulated by image date from the corresponding exposing device (3), to thereby form a latent electrostatic image. The latent electrostatic image formed on the latent image bearing member (1) is developed with the toner using the corresponding developing device (4). Next, the toner image, which has formed by applying the toner to the latent image bearing member with the developing device (4), is transferred from the latent image bearing member (1) to the intermediate transfer medium. The above-described process is performed in four colors of cyan (C), magenta (M), yellow (Y) and black (K), to thereby form a full color toner image.

Figure 4:
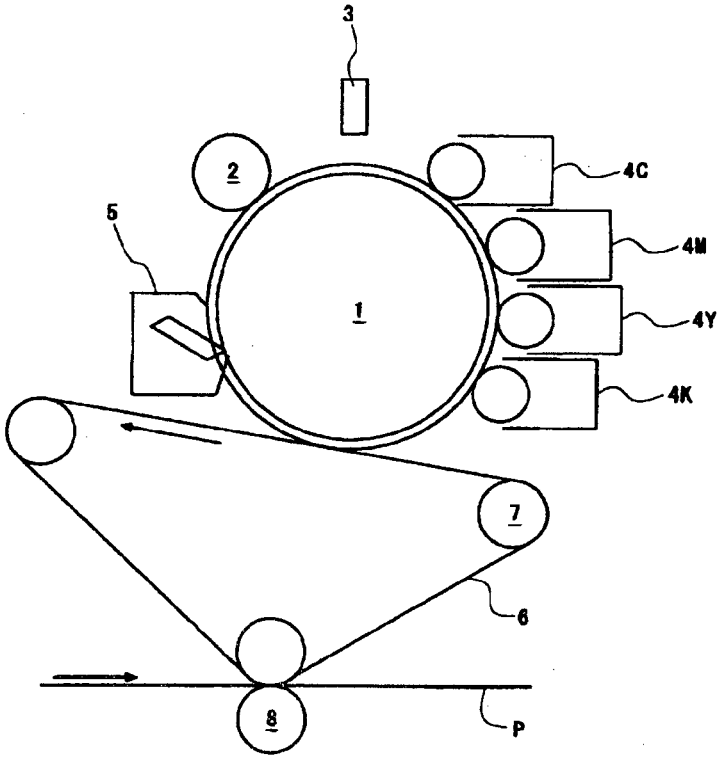
FIG. 4 is an explanatory view of another image forming apparatus in which a toner of the present invention is used.

FIG. 4 is a schematic view of an example of a full color image forming apparatus of a revolver type. This image forming apparatus switches the operation of each developing device to sequentially apply color toners onto one latent image bearing member (1) for development. A transfer roller (8) is used to transfer the color toner image from the intermediate transfer medium (6) onto a recording paper sheet (P), which is then conveyed to a fixing part for obtaining a fixed image.

In the image forming apparatus after the toner image has been transferred from the intermediate transfer member (6) onto the recording paper sheet (P), the latent image bearing member (1) is further rotated to reach a cleaning part (5) where the toner remaining on the surface of the latent image bearing member (1) is scraped off by a blade, followed by charge-eliminating at a charge-eliminating part. Then, the image forming apparatus uniformly charges, with the charging device (2), the latent image bearing member (1) charge-eliminated by the charge-eliminating device, and performs the next image formation in the same manner as described above. Notably, the cleaning part (5) is limited to the part where the toner remaining on the latent image bearing member (1) is scraped off by a blade. For example, the cleaning part (5) may be a part where the toner remaining on the latent image bearing member (1) is scraped off by a fur brush.

The image forming method or image forming apparatus of the present invention uses as a developer the toner of the present invention, and thus can provide good images.

(Process Cartridge)

The process cartridge of the present invention includes a latent image bearing member and a developing unit configured to develop, with a toner, a latent electrostatic image on the latent image bearing member to form a visible image, and is mounted detachably to an image forming apparatus.

The toner of the present invention is used as the above-mentioned toner.

The developing unit has at least a developer container housing the toner or the developer of the present invention, and a developer bearing member which bears and conveys the toner housed in the developer container; and optionally further includes, for example, a toner-regulating blade for regulating the layer thickness of the toner on the developer bearing member. The process cartridge of the present invention can be mounted detachably to various electrophotographic image forming apparatuses, facsimiles and printers. Preferably, it is mounted detachably to the image forming apparatus of the present invention.

Figure 5:
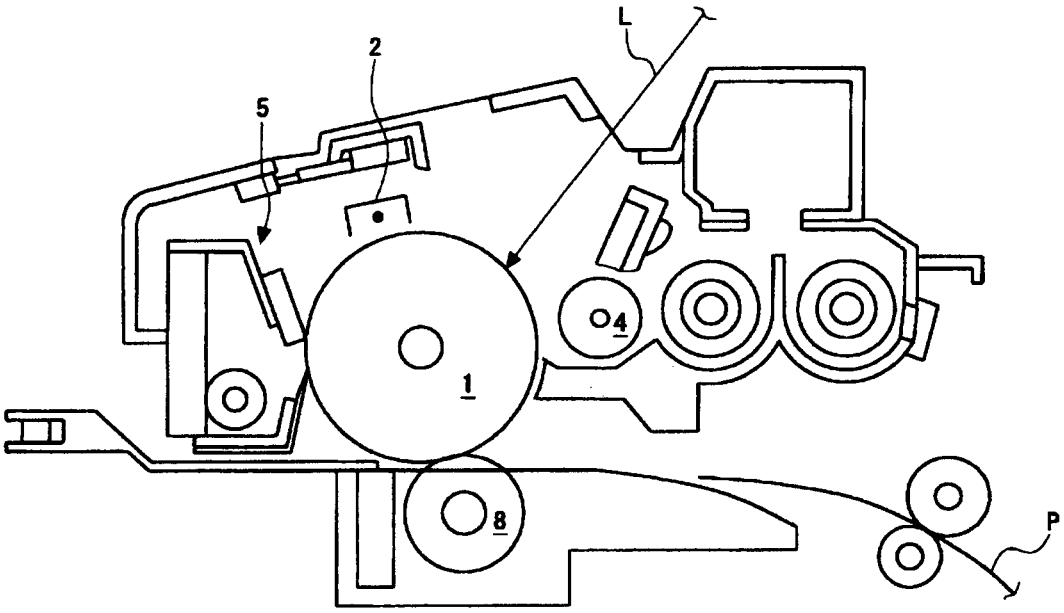
FIG. 5 is an explanatory view of a process cartridge in which a toner of the present invention is used.

As illustrated in FIG. 5, the process cartridge includes a latent image bearing member (1), a charging device (2), a developing device (4), a transfer roller (8) and a cleaning part (5); and, if necessary, further includes other units. In FIG. 5, (L) denotes light emitted from an unillustrated exposing device and (P) denotes a recording paper sheet. The latent image bearing member (1) may be the same as that used in the above-described image forming apparatus. The charging device (2) may be any charging member.

Next, description will be given to image forming process by the process cartridge illustrated in FIG. 5. While being arrowed direction, the latent image bearing member (1) is charged with the charging device (2) and then is exposed to light (L) emitted from the unillustrated exposing unit. As a result, a latent electrostatic image corresponding to an exposure pattern is formed on the surface of the latent image bearing member (1). The latent electrostatic image is developed with the toner in the developing device (4). The developed toner image is transferred with the transfer roller (8) onto the recording paper sheet (P), which is then printed out. Next, the latent image bearing member surface from which the toner image has been transferred is cleaned in the cleaning part (5), and is charge-eliminated with an unillustrated charge-eliminating unit. The above-described process is repeatedly performed.

EXAMPLES

The present invention will next be described in more detail by way of Examples and Comparative Examples, which should not be construed as limiting the present invention thereto.

First will be described analysis and evaluation methods for toners obtained in Examples and Comparative Examples.

Although the following evaluation was made on the toner of the present invention used as a one-component developer, the toner of the present invention can also be used as a two-component developer with suitable external treatment and suitable carriers.

<Measurement of Particle Diameter of Vinyl Fine Resin Particles>

The particle diameter of the vinyl fine resin particles was measured as the volume average particle diameter using UPA-150EX (manufactured by NIKKISO CO., LTD.).

<Measurement of Molecular Weight (GPC)>

The molecular weight of the resin was measured through GPC (gel permeation chromatography) under the following conditions:

Apparatus: GPC-150C (manufactured by Waters Co.)
Column: KF801 to 807 (manufactured by Showdex Co.)
Temperature: 40° C.
Solvent: THF (tetrahydrofuran)
Flow rate: 1.0 mL/min
Sample injected: 0.1 mL of a sample having a concentration of 0.05% by mass to 0.6% by mass From the molecular weight distribution of the resin measured under the above conditions, the number average molecular weight and the weight average molecular weight of the resin were calculated using a molecular weight calibration curve obtained from monodispersed polystyrene standard samples. The standard polystyrene samples used for obtaining the calibration curve were toluene and Std. Nos. S-7300, S-210, S-390, S-875, S-1980, S-10.9, S-629, S-3.0 and S-0.580 of Showdex STANDARD (manufactured by SHOWA DENKO K.K.). The detector used was a RI (refractive index) detector.

<Measurement of Glass Transition Temperature (Tg) (DSC)>

The glass transition temperature (Tg) was measured using TG-DSC system TAS-100 (manufactured by Rigaku Denki Co., Ltd.).

About 10 mg of a sample was placed in an aluminum container, which is placed on a holder unit. The holder unit was then set in an electric oven. The sample was heated from room temperature to 150° C. at a temperature increasing rate of 10° C./min, left to stand at 150° C. for 10 min, cooled to room temperature, and left to stand for 10 min. In a nitrogen atmosphere, the sample was heated again to 150° C. at a temperature increasing rate of 10° C./min for DSC analysis. Using the analysis system of TAS-100 system, the Tg was calculated from the tangent point between the base line and the tangential line of the endothermic curve near the Tg.

<Amount of the Releasing Agent Extracted with Hexane (Amount of Wax Extracted)>

The amount of the releasing agent extracted with hexane (amount of wax extracted) was measured with the following method.

Specifically, 1.0 g of a toner was weighed in a 30-mL glass screw tube at a temperature of 25° C.±2° C. Then, 7 mL of n-hexane was added thereto and the resultant mixture was stirred with a roll mill at 120 rpm for 1 min. The obtained solution was filtrated through aspiration using a PTFE membrane filter having an opening of 1 μm.

The filtrate was dried at 40° C. for 24 hours and the mass of the filtrate after drying was measured. The obtained measurement was defined as the "amount of the extracted releasing agent." The amount of the releasing agent extracted with hexane (amount of wax extracted) was calculated by dividing the "amount of the extracted releasing agent" by 1 g ("amount of the extracted releasing agent"/1 g).

<Asker C Hardness of Developing Roller>

The Asker C hardness of a developing roller is measured with a spring-type hardness tester ASKER C (manufactured by KOBUNSHI KEIKI CO., LTD.).

<Surface Roughness (Ra) of Developing Roller>

The surface roughness (Ra) of a developing roller is measured with a contact surface roughness tester SURFCOM (manufactured by TOKYO SEIMITSU CO., LTD.) according to JIS B0601-1994.

<Measurement of Transmittance>

First, a 1-L polypropylene container is charged with 995 g of ion-exchange water from which solid impurities have been removed in advance.

Next, 5 g of "sodium dodecyl sulfate" (manufactured by KANTO KAGAKU K.K.) serving as a dispersing agent was added to the ion-exchange water, to thereby prepare a 0.5% by mass dispersion liquid.

Then, 40 g of the prepared dispersion liquid was weighed and mixed with 3 g of the toner, followed by stirring for 90 min. The resultant mixture was transferred to a 100-mL stainless cup (manufactured by TOP Co.) where it was irradiated with ultrasonic waves for 5 min using an ultrasonic wave irradiation device ("VCX-750," manufactured by Sonics & Materials, Inc.) the power of which had been set to 80 W.

Before irradiation, it was confirmed that the source of ultrasonic waves was well immersed in the dispersion liquid (at a depth of 1 cm or greater from the liquid surface).

The dispersion liquid was appropriately cooled so that the temperature thereof fell within the range of 10° C. to 40° C. during irradiation of ultrasonic waves.

The toner dispersion liquid (11 mL) after irradiation of ultrasonic waves was placed in a 15-mL centrifugal tube, which was centrifugated at 3,000 rpm for 5 min. The centrifugal apparatus used was "CN-1040" manufactured by HSIAN-GTAI Inc.

The supernatant after centrifugation was sampled in an amount of 1.6 mL from the upper part of the liquid surface. The sampled supernatant was set into the quartz cell of a UV-Vis photospectrometer (UV-2550, manufactured by Shimadzu Corporation) and measured for transmittance with respect to light having a wavelength of 800 nm.

In this measurement, a 0.5% by mass aqueous solution of sodium dodecyl sulfate was used as a reference. The transmittance of the 0.5% by mass aqueous solution of sodium dodecyl sulfate with respect to light having a wavelength of 800 nm was regarded as 100%.

<Ratio of Intensity at 700 $cm^{-1}$ to Intensity at 828 $cm^{-1}$ and Ratio of Intensity at 475 $cm^{-1}$ to Intensity at 828 $cm^{-1}$ as Measured by Attenuated Total Reflection (ATR)>

The following device was used to determine the ratio of intensity at 700 $cm^{-1}$ to intensity at 828 $cm^{-1}$ and the ratio of intensity at 475 $cm^{-1}$ to intensity at 828 $cm^{-1}$ as measured by attenuated total reflection (ATR)

Device name: Spectrum One

Accessories: Universal ATR Accessory

Manufactured by: Perkin Elmer Inc.

<Chargeability (Background Smear)>

The toner was placed in the black (Bk) cartridge of an image forming apparatus (IPSIO SP C220, manufactured by Ricoh Company, Ltd.). The image forming apparatus was caused to print out a blank sheet, to thereby observe the states on the blank sheet and the latent image bearing member (photoconductor). This printing was performed under the NN environment of 23° C. and 40% RH.

[Evaluation Criteria]

A: No toner particles adhered on the blank sheet or the photoconductor.

B: No toner particles adhered on the blank sheet, but slightly adhering toner particles were observed on the photoconductor when the photoconductor was oblique.

C: Slightly adhering toner particles were observed on the blank sheet when the blank sheet was oblique.

D: Toner particles adhering were clearly observed on the blank sheet.

<Adhesion Resistance (NN Environment)>

After printing of 2,000 sheets of white solid image using a modified image forming apparatus IPSIO SP C220 (manufactured by Ricoh Company, Ltd.) in which an elastic roller has the Asker C hardness of 72° and the surface roughness (Ra) of 1.1 μm, the toner attached on the regulating blade was evaluated on the basis of the following 4 ranks. The measurement was performed in an environment in which the temperature was 23° C. and the relative humidity (RH) was 40% (NN environment).

[Evaluation Criteria]

A: No toner adhesion was observed, very good

B: Noticeable toner adhesion was not observed, giving no adverse effects to image quality C: Toner adhesion was observed, giving adverse effects to image quality D: Noticeable toner adhesion was observed, giving considerable adverse effects to image quality <Adhesion Resistance (HH Environment)>

After printing of 2,000 sheets of white solid image using a modified image forming apparatus IPSIO SP C220 (manufactured by Ricoh Company, Ltd.) in which an elastic roller has the Asker C hardness of 72° and the surface roughness (Ra) of 1.1 μm, the toner attached on the regulating blade was evaluated on the basis of the following 4 ranks. The measurement was performed in an environment in which the temperature was 28° C. and the relative humidity (RH) was 80% (HH environment).

[Evaluation Criteria]

A: No toner adhesion was observed, very good

B: Noticeable toner adhesion was not observed, giving no adverse effects to image quality C: Toner adhesion was observed, giving adverse effects to image quality D: Noticeable toner adhesion was observed, giving considerable adverse effects to image quality <Change of Image Density>

Before and after printing of 2,000 sheets having a chart with an image area ratio of 1% using a image forming apparatus (IPSIO SP C220, manufactured by Ricoh Company, Ltd.), a black solid image was printed on paper (TYPE 6000, manufactured by Ricoh Company, Ltd.). Then, the image density was measured with a spectrodensitometer (manufactured by X-Rite) and evaluated for the difference of image density between before and after printing of 2,000 sheets on the basis of the following criteria.

[Evaluation Criteria]

A: Difference<0.1%

B: 0.1%≤Difference<0.2%

C: 0.2%≤Difference<0.3%

D: 0.3%≤Difference

<Fixation Separability>

An image forming apparatus (IPSIO SP C220, manufactured by Ricoh Company, Ltd.) was used to form 6 paper sheets each having an image developed with the toner at 1.1±0.1 mg/cm$^2$. This image was an unfixed, solid image having a blank tip portion of 3 mm in the direction along the longer side of the image.

Separately, the fixing portion was taken from the image forming apparatus and modified so that the temperature and the linear velocity of the fixing belt were adjusted to desired values, whereby a modified fixation testing device was produced. This modified fixation testing device was used to fix the unfixed, solid images on the paper sheets from the 3-mm blank tip portion thereof, with the linear velocity of the fixing belt set to 125 mm/sec and the temperature of the fixing belt increased from 140° C. to 190° C. in increments of 10° C. The fixation separability was evaluated according to the following criteria on the basis of the number of the paper sheets that could be normally fixed without winding around the fixing belt or causing paper jam at the outlet of the fixing device.

[Evaluation Criteria]

A: The number of the paper sheets that could be normally fixed was 5 or more.

B: The number of the paper sheets that could be normally fixed was 4 or less but 3 or more.

C: The number of the paper sheets that could be normally fixed was 2 or less.

<Evaluation Method for OPC Filming>

An image forming apparatus (IPSIO SP C220, manufactured by Ricoh Company, Ltd.) was used to continuously print a predetermined print pattern having an image occupation rate of 1% under the HH environment (28° C., 80% RH). After continuous printing of 5,000 sheets, the latent image bearing member (photoconductor) and the solid image were visually observed and evaluated according to the following criteria.

[Evaluation Criteria]

A: No filming was formed on the photoconductor; there was no problem.

B: Filming was formed on the photoconductor but there were no problems in the image.

C: Filming was formed on the photoconductor and there were problems in the image.

<Charging Stability>

An image forming apparatus (IPSIO SP C220, manufactured by Ricoh Company, Ltd.) containing a toner (developer) having undergone external addition treatment was used to continuously print a predetermined print pattern having a B/W ratio of 6% under the HH environment (28° C., 80% RH). After continuous printing (durable running) of 50 sheets and 2,000 sheets, an aspiration-type compact charge amount meter (MODEL 210HS, product of TREK JAPAN) was used to aspirate off the toner on the developing roller during printing of a blank pattern. And, the charge amounts of the toner after the printing of 50 sheets and 2,000 sheets were measured and evaluated according to the following criteria.

[Evaluation Criteria]

A: The difference between the charge amounts was 15 μC/g or greater but 25 μC/g or smaller as an absolute value.

B: The difference between the charge amounts was 10 μC/g or greater but smaller than 15 μC/g as an absolute value.

C: The difference between the charge amounts was smaller than 10 μC/g as an absolute value.

<Thin Line Reproducibility>

The modified image forming apparatus (IPSIO SP C220, manufactured by Ricoh Company, Ltd.) was used to print, on a paper sheet, a line image of 1×1 dot (1 dot on, 1 dot off) in the axial direction of the latent image bearing member (photoconductor). The thin line image of the obtained image was visually observed and evaluated according to the following criteria.

[Evaluation Criteria]

A: The thin line was reproduced uniformly.

B: The thin line was reproduced almost uniformly, though it was slightly deformed.

C: The thin line was deformed but practically acceptable.

D: The thin line was noticeably deformed and practically inacceptable.

Preparation Examples of Various Materials Used in Examples and Comparative Examples Will Now be Described.

(Preparation Example of Vinyl Fine Resin Dispersion Liquid 1)

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution (106.6 parts by mass) of potassium persulfate (2.6 parts by mass) in ion-exchange water (104 parts by mass) was added to the resultant solution. Fifteen minutes after the addition, a monomer mixture of a styrene monomer (170 parts by mass), methoxydiethylene glycol methacrylate (30 parts by mass), and n-octanethiol (1.4 parts by mass) was added dropwise to the resultant mixture for 90 min. Subsequently, the temperature of the mixture was maintained at 80° C. for 60 min to perform polymerization reaction. Then, the thus obtained reaction product was cooled to obtain white [vinyl fine resin dispersion liquid 1]having the glass transition temperature (Tg) of 72° C., weight average molecular weight (Mw) of 41,300, and volume average particle diameter of 100 nm.

(Preparation Example of Vinyl Fine Resin Dispersion Liquid 2)

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution (106.6 parts by mass) of potassium persulfate (2.6 parts by mass) in ion-exchange water (104 parts by mass) was added to the resultant solution. Fifteen minutes after the addition, a monomer mixture of a styrene monomer (160 parts by mass), methoxydiethylene glycol methacrylate (40 parts by mass), and n-octanethiol (1.4 parts by mass) was added dropwise to the resultant mixture for 90 min. Subsequently, the temperature of the mixture was maintained at 80° C. for 60 min to perform polymerization reaction. Then, the thus obtained reaction product was cooled to obtain white [vinyl fine resin dispersion liquid 2] having the glass transition temperature (Tg) of 62° C., weight average molecular weight (Mw) of 43,500, and volume average particle diameter of 105 nm.

(Preparation Example of Vinyl Fine Resin Dispersion Liquid 3)

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution (106.6 parts by mass) of potassium persulfate (2.6 parts by mass) in ion-exchange water (104 parts by mass) was added to the resultant solution. Fifteen minutes after the addition, a monomer mixture of a styrene monomer (180 parts by mass), n-butyl acrylate (20 parts by mass), and n-octanethiol (1.4 parts by mass) was added dropwise to the resultant mixture for 90 min. Subsequently, the temperature of the mixture was maintained at 80° C. for 60 min to perform polymerization reaction. Then, the thus obtained reaction product was cooled to obtain white [vinyl fine resin dispersion liquid 3] having the glass transition temperature (Tg) of 75° C., weight average molecular weight (Mw) of 40,000, and volume average particle diameter of 105 nm.

(Preparation Example of Vinyl Fine Resin Dispersion Liquid 4)

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution (106.6 parts by mass) of potassium persulfate (2.6 parts by mass) in ion-exchange water (104 parts by mass) was added to the resultant solution. Fifteen minutes after the addition, a monomer mixture of a styrene monomer (170 parts by mass), n-butyl acrylate (30 parts by mass), and n-octanethiol (1.4 parts by mass) was added dropwise to the resultant mixture for 90 min. Subsequently, the temperature of the mixture was maintained at 80° C. for 60 min to perform polymerization reaction. Then, the thus obtained reaction product was cooled to obtain white [vinyl fine resin dispersion liquid 4] having the glass transition temperature (Tg) of 69° C., weight average molecular weight (Mw) of 42,100, and volume average particle diameter of 105 nm.

(Preparation Example of Vinyl Fine Resin Dispersion Liquid 5)

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution (106.6 parts by mass) of potassium persulfate (2.6 parts by mass) in ion-exchange water (104 parts by mass) was added to the resultant solution. Fifteen minutes after the addition, a monomer mixture of a styrene monomer (160 parts by mass), n-butyl acrylate (40 parts by mass), and n-octanethiol (1.4 parts by mass) was added dropwise to the resultant mixture for 90 min. Subsequently, the temperature of the mixture was maintained at 80° C. for 60 min to perform polymerization reaction. Then, the thus obtained reaction product was cooled to obtain white [vinyl fine resin dispersion liquid 5] having the glass transition temperature (Tg) of 60° C., weight average molecular weight (Mw) of 44,000, and volume average particle diameter of 108 nm.

(Preparation Example of Vinyl Fine Resin Dispersion Liquid 6)

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution (106.6 parts by mass) of potassium persulfate (2.6 parts by mass) in ion-exchange water (104 parts by mass) was added to the resultant solution. Fifteen minutes after the addition, a monomer mixture of a styrene monomer (200 parts by mass), and n-octanethiol (1.4 parts by mass) was added dropwise to the resultant mixture for 90 min. Subsequently, the temperature of the mixture was maintained at 80° C. for 60 min to perform polymerization reaction.

Then, the thus obtained reaction product was cooled to obtain white [vinyl fine resin dispersion liquid 6] having the glass transition temperature (Tg) of 95° C., weight average molecular weight (Mw) of 41,500, and volume average particle diameter of 102 nm.

Tables 1-1 and 1-2 summarize vinyl fine resin particles in the [vinyl fine resin particle dispersion liquid 1] to [vinyl fine resin particle dispersion liquid 6] in terms of, for example, the monomer composition and the molecular weight.

TABLE 1-1

| Vinyl fine resin particle dispersion liquid | | | | | | |
|---|---|---|---|---|---|---|
| | Monomer composition | | | | | |
| Vinyl fine resin particle | Styrene (% by mass) | Methoxydiethylene glycol methacrylate (% by mass) | Butyl acrylate (% by mass) | Methyl methacrylate (% by mass) | Methacrylic acid (% by mass) | Acrylic acid (% by mass) |
| Vinyl fine resin particle 1 | 85 | 15 | — | | | — |
| Vinyl fine resin particle 2 | 80 | 20 | | | | |

TABLE 1-1-continued

| Vinyl fine resin particle dispersion liquid | | | | | | |
|---|---|---|---|---|---|---|
| | Monomer composition | | | | | |
| Vinyl fine resin particle | Styrene (% by mass) | Methoxydiethylene glycol methacrylate (% by mass) | Butyl acrylate (% by mass) | Methyl methacrylate (% by mass) | Methacrylic acid (% by mass) | Acrylic acid (% by mass) |
| Vinyl fine resin particle 3 | 90 | | 10 | | | |
| Vinyl fine resin particle 4 | 85 | | 15 | | | |
| Vinyl fine resin particle 5 | 80 | | 20 | | | |
| Vinyl fine resin particle 6 | 100 | — | | | | — |

TABLE 1-2

| Vinyl fine resin particle dispersion liquid | | | | |
|---|---|---|---|---|
| | Chain-transfer agent | Physical property | | |
| Vinyl fine resin particle | 1-octanethiol (% by mass relative to monomer) | Number average molecular weight (Mn) | Weight average molecular weight (Mw) | Glass transition temperature Tg (° C.) |
| Vinyl fine resin particle 1 | 0.7 | 21,500 | 41,300 | 72 |
| Vinyl fine resin particle 2 | 0.7 | 22,000 | 43,500 | 62 |
| Vinyl fine resin particle 3 | 0.7 | 21,000 | 40,000 | 75 |
| Vinyl fine resin particle 4 | 0.7 | 22,500 | 42,100 | 69 |
| Vinyl fine resin particle 5 | 0.7 | 21,300 | 44,000 | 60 |
| Vinyl fine resin particle 6 | 0.7 | 23,000 | 41,500 | 95 |

[Synthesis Example of Non-Crystalline Polyester Resin 1]

A reaction container equipped with a condenser, a stirrer and a nitrogen-introducing pipe was charged with bisphenol A ethylene oxide 2 mol adduct (229 parts by mass), bisphenol A propylene oxide 2 mol adduct (400 parts by mass), terephthalic acid (208 parts by mass), adipic acid (46 parts by mass) and dibutyl tinoxide (2 parts by mass), followed by reaction at 230° C. for 8 hours under normal pressure. Next, the reaction mixture was allowed to react for 7 hours under a reduced pressure of 10 mmHg to 18 mmHg. Then, trimellitic anhydride (20 parts by mass) was added to the reaction container, followed by reaction at 180° C. until a softening point would reach 110° C. under normal pressure, to thereby synthesize [non-crystalline polyester resin 1]. The thus-obtained [non-crystalline polyester resin 1] was found to have a glass transition temperature of 63° C.

[Synthesis Example of Non-Crystalline Polyester Resin 2]

A reaction container equipped with a condenser, a stirrer and a nitrogen-introducing pipe was charged with bisphenol A ethylene oxide 2 mol adduct (1,210 parts by mass), bisphenol A propylene oxide 3 mol adduct (2,750 parts by mass), terephthalic acid (910 parts by mass), adipic acid (190 parts by mass) and dibutyl tinoxide (10 parts by mass), followed by reaction at 230° C. for 8 hours under normal pressure. Next, the reaction mixture was allowed to react for 5 hours under a reduced pressure of 10 mmHg to 18 mmHg. Then, trimellitic anhydride (220 parts by mass) was added to the reaction container, followed by reaction at 180° C. until a softening point would reach 95° C. under normal pressure, to thereby synthesize [non-crystalline polyester resin 2]. The thus-obtained [non-crystalline polyester resin 2] was found to have a glass transition temperature of 49° C.

[Synthesis Example of Crystalline Polyester Resin]

A 5-L four-neck flask equipped with a nitrogen-introducing pipe, a dehydrating pipe, a stirrer and a thermocouple was charged with 1,10-decanedioic acid (2,300 g), 1,8-octanediol (2,530 g) and hydroquinone (4.9 g), followed by reaction at 180° C. for 10 hours. The reaction mixture was allowed to react at 200° C. for 3 hours and further react at 8.3 kPa for 2 hours, to thereby obtain [crystalline polyester resin]. The obtained [crystalline polyester resin] was found to have a number average molecular weight of 3,000 and a weight average molecular weight of 10,000 and to exhibit an endothermic peak at about 70° C. as measured through DSC.

[Synthesis of Prepolymer]

A reaction container equipped with a condenser, a stirrer and a nitrogen-introducing pipe was charged with bisphenol A ethylene oxide 2 mol adduct (682 parts by mass), bisphenol A propylene oxide 2 mol adduct (81 parts by mass), terephthalic acid (283 parts by mass), trimillitic anhydride (22 parts by mass) and dibutyl tinoxide (2 parts by mass), followed by reaction at 230° C. for 8 hours under normal pressure. Next, the reaction mixture was allowed to react for 5 hours under a reduced pressure of 10 mmHg to 15 mmHg, to thereby synthesize [intermediate polyester 1]. The thus-obtained [intermediate polyester 1] was found to have the number average molecular weight of 2,100, the weight average molecular weight of 9,500, the glass transition temperature of 55° C., the acid value of 0.5 mgKOH/g and the hydroxyl value of 49 mgKOH/g.

Next, a reaction container equipped with a condenser, a stirrer and a nitrogen-introducing pipe was charged with [intermediate polyester 1] (411 parts by mass), isophorone diisocyanate (89 parts by mass) and ethyl acetate (500 parts by mass), followed by reaction at 100° C. for 5 hours, to thereby obtain [prepolymer 1].

[Preparation of Masterbatch 1]

C.I. pigment red 122 (40 parts by mass), the above synthesized [non-crystalline polyester resin 1] (60 parts by mass) and water (30 parts by mass) were mixed together using HENSCHEL MIXER, to thereby obtain a mixture containing pigment aggregates impregnated with water. The obtained mixture was kneaded for 45 min with a two-roll mill of which roll surface temperature had been adjusted to 130° C. The kneaded product was pulverized with a pulverizer so as to have a size of 1 mm to thereby obtain [masterbatch 1].

Example 1

<Preparation of Aqueous Phase>

Ion-exchange water (970 parts by mass), 25% by mass aqueous dispersion liquid of fine organic resin particles for stabilizing dispersion (a copolymer of styrene-methacrylic acid-butyl acrylate-sodium salt of methacrylic acid ethylene oxide adduct sulfuric acid ester) (40 parts by mass), 48.5% by mass aqueous solution of sodium dodecyl diphenyl ether disulfonate (95 parts by mass) and ethyl acetate (98 parts by mass) were mixed together under stirring. The resultant mixture was found to have a pH of 6.2. Then, 10% by mass aqueous solution of sodium hydroxide was added dropwise thereto to adjust the pH to 9.5, whereby [aqueous phase 1] was obtained.

<Preparation Step of Wax Dispersion Liquid>

A container equipped with a stirring rod and a thermometer was charged with the [non-crystalline polyester resin 1] (20 parts by mass), [paraffin wax (melting point: 72° C.)] (12 parts by mass), ethyl acetate (100 parts by mass), and styrene-polyethylene polymer (6 parts by mass) (glass transition temperature (Tg): 72° C., number average molecular weight: 7,100) as a wax dispersing agent. The mixture was increased in temperature to 80° C. under stirring, maintained at 80° C. for 5 hours, and cooled to 30° C. for 1 hour, and the wax were dispersed with a bead mill (ULTRA VISCOMILL, manufactured by AIMEX CO., Ltd.) under the following conditions: a liquid feed rate of 1 kg/hr, disc circumferential velocity of 6 m/s, 0.5 mm-zirconia beads packed to 80% by volume, and 3 passes to obtain [wax dispersion liquid 1].

<Preparation Step of Oil Phase>

The [non-crystalline polyester resin 1] (90 parts by mass), the [non-crystalline polyester resin 2] (10 parts by mass), the [crystalline polyester resin] (7 parts by mass), the [master batch 1] (12 parts by mass), the [wax dispersion liquid 1] (33 parts by mass), and ethyl acetate (80 parts by mass) were mixed for 30 min at 8,000 rpm with TK HOMOMIXER (manufactured by Tokushu Kika Kogyo Co., Ltd.). Then, the [prepolymer 1] (15 parts by mass) was added and mixed for 2 min at 8,000 rpm with TK HOMOMIXER, to thereby obtain [oil phase 1]. The solid content of the obtained [oil phase 1] was measured to be 58% by mass.

<Production Step of Core Particles>

The obtained [oil phase 1] (100 parts by mass) and the [aqueous phase 1] (100 parts by mass) were mixed for 2 min with TK HOMOMIXER at 8,000 rpm to 15,000 rpm, while being adjusted to 20° C. to 23° C. in a water bath to suppress increase in temperature due to shear heat of the mixer. Thereafter, the mixture was stirred for 10 min at 130 rpm to 350 rpm using a three-one motor equipped with an anchor wing, to thereby obtain [core particle slurry 1] containing liquid droplets of the oil phase (core particles) dispersed in the aqueous phase.

<Attachment Step of Fine Resin Particle>

The [vinyl fine resin particle dispersion liquid 1] (11.6 parts by mass) was mixed with ion-exchange water (20.8 parts by mass). The resultant mixture was added dropwise for 3 min to the [core particle slurry 1] while keeping its temperature at 22° C. and being stirred at 130 rpm to 350 rpm with a three-one motor equipped with an anchor wing. Thereafter, the mixture was further stirred for 30 min at 200 rpm to 450 rpm to obtain [composite particle slurry 1].

<Desolvation Step>

A container equipped with a stirrer and a thermometer was charged with the [composite particle slurry 1], which was desolvated with stirring at 30° C. for 8 hours to obtain [dispersion slurry 1].

<Washing/Drying Step>

After the [dispersion slurry 1] (100 parts by mass) had been filtrated under reduced pressure, the following treatments (1) to (4) were performed.

(1) Ion-exchange water (100 parts by mass) was added to the filtration cake, followed by mixing with TK HOMOMIXER (at 12,000 rpm for 10 min) and filtrating.

(2) Ion-exchange water (900 parts by mass) was added to the filtration cake obtained in (1). The resultant mixture was mixed with TK HOMOMIXER (at 12,000 rpm for 30 min), followed by filtrating under reduced pressure. This treatment was repeated until the reslurry had an electrical conductivity of 10 μC/cm or lower.

(3) 10% by mass hydrochloric acid was added to the reslurry obtained in (2) so as to have the pH of 4, followed by stirring for 30 min with a three-one motor and filtrating.

(4) Ion-exchange water (100 parts by mass) was added to the filtration cake obtained in (3), followed by mixing with TK HOMOMIXER (at 12,000 rpm for 10 min) and filtrating. This treatment was repeated until the reslurry had an electrical conductivity of 10 μC/cm or lower, to thereby obtain [filtration cake 1].

The [filtration cake 1] was dried with an air-circulation dryer at 45° C. for 48 hours, and then sieved with a mesh having an opening size of 75 μm to obtain [toner base particle 1].

<Step of Firmly Bonding Protrusions>

<<Bonding with Mechanical Force>>

The obtained [toner base particles 1] (100 parts by mass) were placed in a modified HENSCHEL MIXER (10 liter) where they were mixed and stirred at 5,000 rpm for 30 min, to thereby obtain [post-treatment toner base particle 1].

Figure 6:
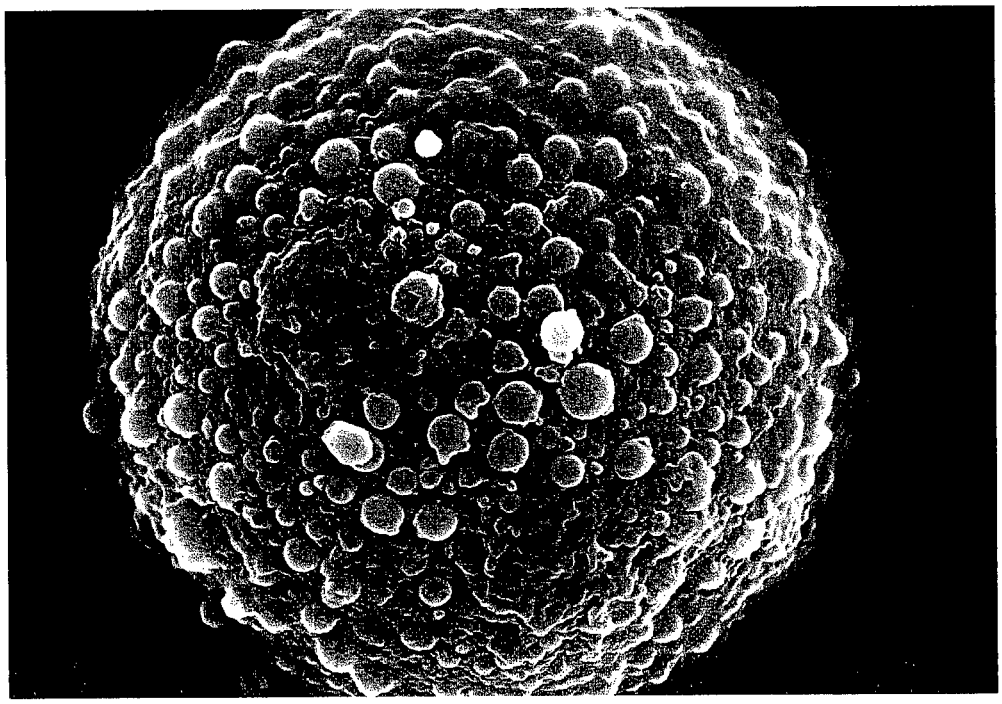
FIG. 6 is a scanning electron microscope (SEM) image of [post-treatment toner base particle 1] of Example 1.

FIG. 6 is a scanning electron microscope (SEM) image of the obtained [post-treatment toner base particle 1]. In this image, flattened vinyl fine resin particles are fused and protruded on the surface of the core particle to form convex portions.

<Addition Step of External Additives>

[Toner base particle 1] (100 parts by mass), silica fine powder RY50 (0.9 parts by mass) (manufactured by Nippon Aerosil Co., Ltd.;

average primary particle diameter: 40 nm; pretreated with silicone oil), and H20TM (2.8 parts by mass) (manufactured by Clariant (Japan) K.K.; average primary particle diameter: 12 nm) were mixed together using HENSCHEL MIXER. The resultant mixture was caused to pass through a sieve with an opening size of 60 μm to remove coarse particles and aggregates, whereby [toner 1] was obtained.

Example 2

[Toner 2] was produced in the same manner as in Example 1 except that the [toner base particle 1] was subjected to the following heat treatment before the treatment with the external additives.

<Heat Treatment of Toner Base Particles>

The [toner base particle 1] (100 parts by mass) was placed in a thermostat bath of 60° C. for 24 hours to thereby obtain [post-treatment toner base particle 2]. The obtained [post-treatment toner base particle 2] was observed under a scanning electron microscope. As a result, it was confirmed that the fine resin particles were firmly attached on the toner base particles and the toner base particles had protrusions on the surfaces thereof.

Example 3

<Step of Thoroughly Washing Toner Base Particles>

The [toner base particle 1] obtained in Example 1 was treated as follows.

<<Thorough Washing of Toner (Rewashing)>>

The obtained [toner base particle 1] (100 parts by mass) was added to a 48.5% by mass solution of sodium dodecyldiphenylether disulfonate in ion-exchange water (350 parts by mass), followed by stirring for 90 min, to thereby prepare [dispersion slurry 2]. The [dispersion slurry 2] was irradiated with ultrasonic waves for 20 min using an ultrasonic wave irradiation device the power of which was set to 80 W.

The dispersion liquid was appropriately cooled so that the temperature thereof fell within the range of 10° C. to 40° C.

The ultrasonic wave irradiation device used was "VCX-750" (manufactured by Sonics & Materials, Inc.).

After irradiated with ultrasonic waves, the [dispersion slurry 2] (100 parts by mass) was filtrated under reduced pressure similar to the above washing step (1) and then subjected to the following steps (2) to (4). (2) Ion-exchange water (900 parts by mass) was added to the filtration cake obtained in (1). The resultant mixture was mixed with TK HOMOMIXER (at 12,000 rpm for 30 min), followed by filtrating under reduced pressure. This treatment was repeated until the reslurry had an electrical conductivity of 10 μC/cm or lower.

(3) 10% by mass hydrochloric acid was added to the reslurry obtained in (2) so as to have the pH of 4, followed by stirring for 30 min with a three-one motor and filtrating.

(4) Ion-exchange water (100 parts by mass) was added to the filtration cake obtained in (3), followed by mixing with TK HOMOMIXER (at 12,000 rpm for 10 min) and filtrating. This treatment was repeated until the reslurry had an electrical conductivity of 10 μC/cm or lower, to thereby obtain [filtration cake 2].

The [filtration cake 2] was dried with an air-circulation dryer at 45° C. for 48 hours, and then sieved with a mesh having an opening size of 75 μm to obtain [post-treatment toner base particle 3].

The obtained [post-treatment toner base particle 3] was observed under a scanning electron microscope. As a result, it was confirmed that the fine resin particles were firmly attached on the toner base particles and the toner base particles had protrusions on the surfaces thereof.

Then, the obtained [post-treatment toner base particle 3] (100 parts by mass), silica fine powder RY50 (0.9 parts by mass) (manufactured by Nippon Aerosil Co., Ltd.; average primary particle diameter: 40 nm; pretreated with silicone oil), and H20TM (2.8 parts by mass) (manufactured by Clariant (Japan) K.K.; average primary particle diameter: 12 nm; pretreated with hexamethyldisilazane) were mixed together using HENSCHEL MIXER. The resultant mixture was caused to pass through a sieve with an opening size of 60 μm to remove coarse particles and aggregates, whereby [toner 3] was obtained.

Examples 4 to 33

[Toner 4] to [Toner 33] of Examples 4 to 33 were obtained in the same manner as in Example 1 except that the type of the vinyl fine resin particle dispersion liquid, the amount of the vinyl fine resin particle dispersion liquid, the treatment method of the toner base particles, the type of the external additives, the amounts of the external additives, and the amount of the wax were changed to those described in Tables 2-1, 2-1, 2-3 and 2-4. Through observation under a scanning electron microscope, protrusions were found on the surfaces of the obtained toner base particles.

Notably, the external additives used are as follows.

<External Additives>

Silica fine powder RY50 [manufactured by Nippon Aerosil Co., Ltd.; average primary particle diameter: 40 nm; pretreated with silicone oil]

H20TM [manufactured by Clariant (Japan) K.K.; average primary particle diameter: 12 nm; pretreated with hexamethyldisilazane]

RX50 [manufactured by Nippon Aerosil Co., Ltd.; average primary particle diameter: 40 nm; pretreated with hexamethyldisilazane]

MSP009 [manufactured by Tayca Corporation; average primary particle diameter: 80 nm; pretreated with aminosilane/silicone oil]

Example 34

[Toner 34] was obtained in the same manner as in Example 1, except that the amount of [wax dispersion liquid 1] in the preparation step of oil phase was changed to 60 parts by mass, and the amount of [vinyl fine resin particle dispersion liquid 1] in the attachment step of fine resin particles was changed to 10.0 parts by mass. Through observation under a scanning electron microscope, protrusions were found on the surfaces of the obtained toner base particles.

Example 35

[Toner 35] was obtained in the same manner as in Example 1, except that the amount of [wax dispersion liquid 1] in the preparation step of oil phase was changed to 73 parts by mass. Through observation under a scanning electron microscope, protrusions were found on the surfaces of the obtained toner base particles.

Example 36

[Toner 36] was obtained in the same manner as in Example 1, except that the amount of [wax dispersion liquid 1] in the preparation step of oil phase was changed to 140 parts by mass, and the amount of [vinyl fine resin particle dispersion liquid 1] in the attachment step of fine resin particles was changed to 9.0 parts by mass. Through observation under a scanning electron microscope, protrusions were found on the surfaces of the obtained toner base particles.

Example 37

[Toner 37] was obtained in the same manner as in Example 1, except that the amount of [wax dispersion liquid 1] in the preparation step of oil phase was changed to 160 parts by mass. Through observation under a scanning electron microscope, protrusions were found on the surfaces of the obtained toner base particles.

Example 38

[Toner 38] was obtained in the same manner as in Example 1, except that the external additives were changed as represented by Table 2-2. Through observation under a scanning electron microscope, protrusions were found on the surfaces of the obtained toner base particles.

Example 39

[Toner 39] was obtained in the same manner as in Example 1, except that in the production step of core particles, a styrene-polyethylene polymer (glass transition temperature Tg=72° C., number average molecular weight: 7,100) (1.0 part by mass) was further added to the [oil phase 1] (100 parts by mass) and the [aqueous phase 1] (100 parts by mass). Through observation under a scanning electron microscope, protrusions were found on the surfaces of the obtained toner base particles.

Comparative Example 1

[Toner base particle 24] was obtained in the same manner as in Example 1, except that the attachment step of fine resin particles was not performed. The obtained [toner base particle 24] was not subjected to post-treatment but added with external additives in the same manner as in Example 1 to thereby obtain [toner 101] of Comparative Example 1.

Comparative Examples 2 to 4

[Toner 102] to [Toner 104] of Comparative Examples 2 to 4 were obtained in the same manner as in Example 1, except that the [toner base particle 24] obtained in Comparative Example 1 was subjected to each of the treatments shown in the column of "Treatment method" in Table 2-4 before the treatment with the external additives.

Comparative Example 5

[Toner 105] of Comparative Example 5 was obtained in the same manner as in Example 1, except that the [toner base particle 1] obtained in Example 1 was subjected directly to the treatment with the external additives without being subjected to the post-treatment.

Comparative Examples 6 to 11

[Toner 106] to [Toner 111] of Comparative Examples 6 to 11 were obtained in the same manner as in Example 1, except that the amount of the vinyl fine resin particle dispersion liquid and the treatment method were changed as shown in Tables 2-2 and 2-4.

Comparative Example 12

[Toner 112] of Comparative Example 12 was obtained in the same manner as in Example 1, except that the type and the amount of the vinyl fine resin particle dispersion liquid and the treatment method were changed as shown in Tables 2-2 and 2-4.

Next, evaluation results of the toners of Examples 1 to 39 and Comparative Examples 1 to 12 are shown in the following Tables 3-1, 3-2, 3-3 and 3-4.

Examples 40 to 49 and Comparative Examples 13 to 22

The [Toner 1] and the [Toner 105] were evaluated for adhesion resistance (under the NN and HH environments) and thin line reproducibility using a modified image forming apparatus (IPSIO SP C220, manufactured by Ricoh Company, Ltd.) where the Asker C hardness and the surface roughness Ra of the elastic roller were changed as shown in Table 4. The evaluation results are shown in Table 4 in combination with the Asker C hardness and the surface roughness Ra of the elastic roller.

TABLE 2-1

| | Toner | Fine resin particle dispersion liquid | Amount of vinyl fine resin particle dispersion liquid (% by mass relative to core particle) | Amount of external additives (parts by mass) | | | |
|---|---|---|---|---|---|---|---|
| | | | | H20TM | RY50 | RX50 | MSP009 |
| Ex. 1 | Toner 1 | Vinyl fine resin particle dispersion liquid 1 | 5 | 2.8 | 0.9 | | |
| Ex. 2 | Toner 2 | Vinyl fine resin particle dispersion liquid 1 | 5 | 2.8 | 0.9 | | |
| Ex. 3 | Toner 3 | Vinyl fine resin particle dispersion liquid 1 | 5 | 2.8 | 0.9 | | |
| Ex. 4 | Toner 4 | Vinyl fine resin particle dispersion liquid 1 | 3 | 2.8 | 0.9 | | |
| Ex. 5 | Toner 5 | Vinyl fine resin particle dispersion liquid 1 | 8 | 2.8 | 0.9 | | |
| Ex. 6 | Toner 6 | Vinyl fine resin particle dispersion liquid 1 | 10 | 2.8 | 0.9 | | |
| Ex. 7 | Toner 7 | Vinyl fine resin particle dispersion liquid 2 | 5 | 2.8 | 0.9 | | |
| Ex. 8 | Toner 8 | Vinyl fine resin particle dispersion liquid 2 | 5 | 2.8 | 0.9 | | |
| Ex. 9 | Toner 9 | Vinyl fine resin particle dispersion liquid 2 | 5 | 2.8 | 0.9 | | |
| Ex. 10 | Toner 10 | Vinyl fine resin particle dispersion liquid 3 | 5 | 2.8 | 0.9 | | |
| Ex. 11 | Toner 11 | Vinyl fine resin particle dispersion liquid 3 | 5 | 2.8 | 0.9 | | |
| Ex. 12 | Toner 12 | Vinyl fine resin particle dispersion liquid 3 | 5 | 2.8 | 0.9 | | |
| Ex. 13 | Toner 13 | Vinyl fine resin particle dispersion liquid 4 | 5 | 2.8 | 0.9 | | |

TABLE 2-1-continued

| | Toner | Fine resin particle dispersion liquid | Amount of vinyl fine resin particle dispersion liquid (% by mass relative to core particle) | Amount of external additives (parts by mass) | | | |
|---|---|---|---|---|---|---|---|
| | | | | H20TM | RY50 | RX50 | MSP009 |
| Ex. 14 | Toner 14 | Vinyl fine resin particle dispersion liquid 4 | 5 | 2.8 | 0.9 | | |
| Ex. 15 | Toner 15 | Vinyl fine resin particle dispersion liquid 4 | 5 | 2.8 | 0.9 | | |
| Ex. 16 | Toner 16 | Vinyl fine resin particle dispersion liquid 4 | 8 | 2.8 | 0.9 | | |
| Ex. 17 | Toner 17 | Vinyl fine resin particle dispersion liquid 4 | 10 | 2.8 | 0.9 | | |
| Ex. 18 | Toner 18 | Vinyl fine resin particle dispersion liquid 5 | 5 | 2.8 | 0.9 | | |
| Ex. 19 | Toner 19 | Vinyl fine resin particle dispersion liquid 5 | 5 | 2.8 | 0.9 | | |
| Ex. 20 | Toner 20 | Vinyl fine resin particle dispersion liquid 5 | 5 | 2.8 | 0.9 | | |
| Ex. 21 | Toner 21 | Vinyl fine resin particle dispersion liquid 6 | 5 | 2.8 | 0.9 | | |
| Ex. 22 | Toner 22 | Vinyl fine resin particle dispersion liquid 6 | 5 | 2.8 | 0.9 | | |
| Ex. 23 | Toner 23 | Vinyl fine resin particle dispersion liquid 6 | 5 | 2.8 | 0.9 | | |
| Ex. 24 | Toner 24 | Vinyl fine resin particle dispersion liquid 6 | 10 | 2.8 | 0.9 | | |
| Ex. 25 | Toner 25 | Vinyl fine resin particle dispersion liquid 1 | 5 | 2.0 | 0.6 | | |

TABLE 2-2

| | Toner | Fine resin particle dispersion liquid | Amount of vinyl fine resin particle dispersion liquid (% by mass relative to core particle) | Amount of external additives (parts by mass) | | | |
|---|---|---|---|---|---|---|---|
| | | | | H20TM | RY50 | RX50 | MSP009 |
| Ex. 26 | Toner 26 | Vinyl fine resin particle dispersion liquid 1 | 5 | 1.8 | 0.6 | | |
| Ex. 27 | Toner 27 | Vinyl fine resin particle dispersion liquid 1 | 5 | 1.5 | 1.2 | | |
| Ex. 28 | Toner 28 | Vinyl fine resin particle dispersion liquid 1 | 5 | 1.1 | 1.2 | | |
| Ex. 29 | Toner 29 | Vinyl fine resin particle dispersion liquid 1 | 5 | 3.6 | 2.0 | | |
| Ex. 30 | Toner 30 | Vinyl fine resin particle dispersion liquid 1 | 5 | 3.9 | 2.2 | | |
| Ex. 31 | Toner 31 | Vinyl fine resin particle dispersion liquid 1 | 5 | 2.8 | | 0.9 | |
| Ex. 32 | Toner 32 | Vinyl fine resin particle dispersion liquid 1 | 5 | 2.8 | 0.9 | | 0.9 |
| Ex. 33 | Toner 33 | Vinyl fine resin particle dispersion liquid 1 | 5 | 2.8 | | | 0.9 |
| Ex. 34 | Toner 34 | Vinyl fine resin particle dispersion liquid 1 | 5 | 2.8 | 0.9 | | |
| Ex. 35 | Toner 35 | Vinyl fine resin particle dispersion liquid 1 | 5 | 2.8 | 0.9 | | |
| Ex. 36 | Toner 36 | Vinyl fine resin particle dispersion liquid 1 | 5 | 2.8 | 0.9 | | |
| Ex. 37 | Toner 37 | Vinyl fine resin particle dispersion liquid 1 | 5 | 2.8 | 0.9 | | |
| Ex. 38 | Toner 38 | Vinyl fine resin particle dispersion liquid 1 | 5 | 2.8 | 0.9 | | 0.9 |
| Ex. 39 | Toner 39 | Vinyl fine resin particle dispersion liquid 1 | 5 | 2.8 | 0.9 | | |
| Comp. Ex. 1 | Toner 101 | None | — | 2.8 | 0.9 | | |
| Comp. Ex. 2 | Toner 102 | None | — | 2.8 | 0.9 | | |
| Comp. Ex. 3 | Toner 103 | None | — | 2.8 | 0.9 | | |
| Comp. Ex. 4 | Toner 104 | None | — | 2.8 | 0.9 | | |
| Comp. Ex. 5 | Toner 105 | Vinyl fine resin particle dispersion liquid 1 | 5 | 2.8 | 0.9 | | |

TABLE 2-2-continued

| | Toner | Fine resin particle dispersion liquid | Amount of vinyl fine resin particle dispersion liquid (% by mass relative to core particle) | Amount of external additives (parts by mass) | | | |
|---|---|---|---|---|---|---|---|
| | | | | H20TM | RY50 | RX50 | MSP009 |
| Comp. Ex. 6 | Toner 106 | Vinyl fine resin particle dispersion liquid 1 | 1 | 2.8 | 0.9 | | |
| Comp. Ex. 7 | Toner 107 | Vinyl fine resin particle dispersion liquid 1 | 2 | 2.8 | 0.9 | | |
| Comp. Ex. 8 | Toner 108 | Vinyl fine resin particle dispersion liquid 1 | 15 | 2.8 | 0.9 | | |
| Comp. Ex. 9 | Toner 109 | Vinyl fine resin particle dispersion liquid 1 | 15 | 2.8 | 0.9 | | |
| Comp. Ex. 10 | Toner 110 | Vinyl fine resin particle dispersion liquid 1 | 15 | 2.8 | 0.9 | | |
| Comp. Ex. 11 | Toner 111 | Vinyl fine resin particle dispersion liquid 1 | 20 | 2.8 | 0.9 | | |
| Comp. Ex. 12 | Toner 112 | Vinyl fine resin particle dispersion liquid 6 | 20 | 2.8 | 0.9 | | |

TABLE 2-3

| | Toner | Treatment method | Transmittance at 800 nm | ATR intensity | | Content of wax (% by mass) | Amount of wax extracted (mg/g) |
|---|---|---|---|---|---|---|---|
| | | | | 700 $cm^{-1}$/828 $cm^{-1}$ | 475 $cm^{-1}$/828 $cm^{-1}$ | | |
| Ex. 1 | Toner 1 | Bonding with mechanical force | 85% | 0.41 | 0.24 | 2.1 | 6.2 |
| Ex. 2 | Toner 2 | Heating toner base | 79% | 0.42 | 0.25 | 2.1 | 6.4 |
| Ex. 3 | Toner 3 | Re-washing | 80% | 0.23 | 0.24 | 2.1 | 6.4 |
| Ex. 4 | Toner 4 | Bonding with mechanical force | 94% | 0.25 | 0.24 | 2.1 | 6.3 |
| Ex. 5 | Toner 5 | Bonding with mechanical force | 60% | 0.68 | 0.24 | 2.0 | 6.7 |
| Ex. 6 | Toner 6 | Bonding with mechanical force | 51% | 0.87 | 0.24 | 2.0 | 6.2 |
| Ex. 7 | Toner 7 | Bonding with mechanical force | 90% | 0.40 | 0.25 | 2.1 | 6.3 |
| Ex. 8 | Toner 8 | Heating toner base | 89% | 0.43 | 0.25 | 2.1 | 6.3 |
| Ex. 9 | Toner 9 | Re-washing | 85% | 0.21 | 0.24 | 2.1 | 6.2 |
| Ex. 10 | Toner 10 | Bonding with mechanical force | 70% | 0.44 | 0.24 | 2.1 | 6.4 |
| Ex. 11 | Toner 11 | Heating toner base | 71% | 0.42 | 0.23 | 2.1 | 6.3 |
| Ex. 12 | Toner 12 | Re-washing | 69% | 0.20 | 0.24 | 2.1 | 6.3 |
| Ex. 13 | Toner 13 | Bonding with mechanical force | 85% | 0.42 | 0.24 | 2.1 | 6.3 |
| Ex. 14 | Toner 14 | Heating toner base | 82% | 0.41 | 0.24 | 2.1 | 6.4 |
| Ex. 15 | Toner 15 | Re-washing | 83% | 0.22 | 0.25 | 2.1 | 6.4 |
| Ex. 16 | Toner 16 | Bonding with mechanical force | 65% | 0.67 | 0.24 | 2.0 | 6.2 |
| Ex. 17 | Toner 17 | Bonding with mechanical force | 58% | 0.90 | 0.24 | 2.0 | 6.2 |
| Ex. 18 | Toner 18 | Bonding with mechanical force | 93% | 0.44 | 0.23 | 2.1 | 6.4 |
| Ex. 19 | Toner 19 | Heating toner base | 94% | 0.41 | 0.24 | 2.1 | 6.4 |
| Ex. 20 | Toner 20 | Re-washing | 92% | 0.18 | 0.24 | 2.1 | 6.4 |
| Ex. 21 | Toner 21 | Bonding with mechanical force | 65% | 0.41 | 0.24 | 2.1 | 6.2 |
| Ex. 22 | Toner 22 | Heating toner base | 66% | 0.42 | 0.24 | 2.1 | 6.3 |
| Ex. 23 | Toner 23 | Re-washing | 61% | 0.20 | 0.24 | 2.1 | 6.3 |
| Ex. 24 | Toner 24 | Re-washing | 86% | 0.67 | 0.24 | 2.0 | 6.2 |
| Ex. 25 | Toner 25 | Bonding with mechanical force | 85% | 0.41 | 0.16 | 2.1 | 6.4 |

TABLE 2-4

| | Toner | Treatment method | Transmittance at 800 nm | ATR intensity 700 $cm^{-1}$/828 $cm^{-1}$ | ATR intensity 475 $cm^{-1}$/828 $cm^{-1}$ | Content of wax (% by mass) | Amount of wax extracted (mg/g) |
|---|---|---|---|---|---|---|---|
| Ex. 26 | Toner 26 | Bonding with mechanical force | 88% | 0.41 | 0.14 | 2.1 | 6.2 |
| Ex. 27 | Toner 27 | Bonding with mechanical force | 87% | 0.41 | 0.17 | 2.1 | 6.2 |
| Ex. 28 | Toner 28 | Bonding with mechanical force | 89% | 0.41 | 0.14 | 2.1 | 6.4 |
| Ex. 29 | Toner 29 | Bonding with mechanical force | 89% | 0.41 | 0.39 | 2.1 | 6.7 |
| Ex. 30 | Toner 30 | Bonding with mechanical force | 88% | 0.41 | 0.41 | 2.1 | 6.2 |
| Ex. 31 | Toner 31 | Bonding with mechanical force | 86% | 0.41 | 0.25 | 2.1 | 6.3 |
| Ex. 32 | Toner 32 | Bonding with mechanical force | 86% | 0.41 | 0.30 | 2.1 | 6.3 |
| Ex. 33 | Toner 33 | Bonding with mechanical force | 87% | 0.41 | 0.24 | 2.1 | 6.2 |
| Ex. 34 | Toner 34 | Bonding with mechanical force | 88% | 0.39 | 0.24 | 3.6 | 9.2 |
| Ex. 35 | Toner 35 | Bonding with mechanical force | 88% | 0.38 | 0.24 | 4.3 | 10.5 |
| Ex. 36 | Toner 36 | Bonding with mechanical force | 88% | 0.36 | 0.25 | 7.6 | 20.4 |
| Ex. 37 | Toner 37 | Bonding with mechanical force | 88% | 0.35 | 0.24 | 8.4 | 23.3 |
| Ex. 38 | Toner 38 | Bonding with mechanical force | 86% | 0.40 | 0.31 | 4.3 | 10.3 |
| Ex. 39 | Toner 39 | Bonding with mechanical force | 88% | 0.44 | 0.25 | 4.3 | 9.2 |
| Comp. Ex. 1 | Toner 101 | None | 98% | 0 | 0.25 | 2.2 | 6.8 |
| Comp. Ex. 2 | Toner 102 | Bonding with mechanical force | 98% | 0 | 0.24 | 2.2 | 6.7 |
| Comp. Ex. 3 | Toner 103 | Heating toner base | 98% | 0 | 0.25 | 2.2 | 6.7 |
| Comp. Ex. 4 | Toner 104 | Re-washing | 99% | 0 | 0.25 | 2.2 | 6.8 |
| Comp. Ex. 5 | Toner 105 | None | 47% | 0.32 | 0.24 | 2.1 | 6.6 |
| Comp. Ex. 6 | Toner 106 | Bonding with mechanical force | 97% | 0.07 | 0.23 | 2.1 | 6.5 |
| Comp. Ex. 7 | Toner 107 | Heating toner base | 96% | 0.16 | 0.24 | 2.1 | 6.5 |
| Comp. Ex. 8 | Toner 108 | Bonding with mechanical force | 45% | 1.18 | 0.25 | 1.9 | 6.1 |
| Comp. Ex. 9 | Toner 109 | Heating toner base | 43% | 1.22 | 0.24 | 1.9 | 6.0 |
| Comp. Ex. 10 | Toner 110 | Re-washing | 42% | 0.98 | 0.25 | 1.9 | 6.0 |
| Comp. Ex. 11 | Toner 111 | Bonding with mechanical force | 23% | 1.66 | 0.25 | 1.8 | 5.8 |
| Comp. Ex. 12 | Toner 112 | Bonding with mechanical force | 12% | 1.57 | 0.23 | 1.8 | 5.6 |

TABLE 3-1

| | Evaluation results | | | |
|---|---|---|---|---|
| | Background smear | Adhesion resistance (NN) | Change in image density | Adhesion resistance (HH) |
| Ex. 1 | A | A | A | A |
| Ex. 2 | A | B | A | B |
| Ex. 3 | A | A | A | C |
| Ex. 4 | B | B | B | C |
| Ex. 5 | B | A | A | A |
| Ex. 6 | A | C | A | C |
| Ex. 7 | B | A | B | A |
| Ex. 8 | B | A | B | A |
| Ex. 9 | B | A | A | C |
| Ex. 10 | B | B | A | B |
| Ex. 11 | A | B | A | B |
| Ex. 12 | B | A | A | C |
| Ex. 13 | A | A | A | A |
| Ex. 14 | A | B | A | B |
| Ex. 15 | A | A | A | C |
| Ex. 16 | A | A | A | A |
| Ex. 17 | A | B | A | B |

TABLE 3-1-continued

| | Evaluation results | | | |
|---|---|---|---|---|
| | Background smear | Adhesion resistance (NN) | Change in image density | Adhesion resistance (HH) |
| Ex. 18 | B | A | B | A |
| Ex. 19 | B | A | B | A |
| Ex. 20 | B | A | B | C |
| Ex. 21 | A | B | A | B |
| Ex. 22 | A | B | A | B |
| Ex. 23 | A | B | A | C |
| Ex. 24 | A | A | B | A |
| Ex. 25 | A | B | B | B |

TABLE 3-2

| | Evaluation results | | | |
|---|---|---|---|---|
| | Background smear | Adhesion resistance (NN) | Change in image density | Adhesion resistance (HH) |
| Ex. 26 | B | C | B | C |
| Ex. 27 | A | B | A | B |
| Ex. 28 | C | B | A | C |
| Ex. 29 | B | A | B | B |
| Ex. 30 | B | B | C | B |
| Ex. 31 | A | A | A | B |
| Ex. 32 | A | A | A | A |
| Ex. 33 | A | A | A | A |
| Ex. 34 | A | A | A | A |
| Ex. 35 | A | A | A | A |
| Ex. 36 | A | A | A | B |
| Ex. 37 | A | B | A | C |
| Ex. 38 | A | A | A | A |
| Ex. 39 | A | A | A | A |
| Comp. Ex. 1 | D | D | D | D |
| Comp. Ex. 2 | D | D | D | D |
| Comp. Ex. 3 | D | D | D | D |
| Comp. Ex. 4 | D | D | D | D |
| Comp. Ex. 5 | B | D | A | D |
| Comp. Ex. 6 | C | D | D | D |
| Comp. Ex. 7 | C | C | C | D |
| Comp. Ex. 8 | B | D | B | D |
| Comp. Ex. 9 | B | D | B | D |
| Comp. Ex. 10 | B | D | A | D |
| Comp. Ex. 11 | B | D | A | D |
| Comp. Ex. 12 | B | D | B | D |

TABLE 3-3

| | Evaluation results | | |
|---|---|---|---|
| | Fixing separability | Charging stability | OPC filming |
| Ex. 1 | B | B | A |
| Ex. 2 | B | B | A |
| Ex. 3 | B | B | A |
| Ex. 4 | B | B | A |
| Ex. 5 | B | B | A |
| Ex. 6 | B | B | A |
| Ex. 7 | B | B | A |
| Ex. 8 | B | B | A |
| Ex. 9 | B | B | A |
| Ex. 10 | B | B | A |
| Ex. 11 | B | B | A |
| Ex. 12 | B | B | A |

TABLE 3-3-continued

| | Evaluation results | | |
|---|---|---|---|
| | Fixing separability | Charging stability | OPC filming |
| Ex. 13 | B | B | A |
| Ex. 14 | B | B | A |
| Ex. 15 | B | B | A |
| Ex. 16 | B | B | A |
| Ex. 17 | B | B | A |
| Ex. 18 | B | B | A |
| Ex. 19 | B | B | A |
| Ex. 20 | B | B | A |
| Ex. 21 | B | B | A |
| Ex. 22 | B | B | A |
| Ex. 23 | B | B | A |
| Ex. 24 | B | B | A |
| Ex. 25 | B | B | A |

TABLE 3-4

| | Evaluation results | | |
|---|---|---|---|
| | Fixing separability | Charging stability | OPC filming |
| Ex. 26 | B | B | A |
| Ex. 27 | B | B | A |
| Ex. 28 | B | B | A |
| Ex. 29 | B | B | A |
| Ex. 30 | B | B | A |
| Ex. 31 | B | B | B |
| Ex. 32 | B | A | A |
| Ex. 33 | B | A | B |
| Ex. 34 | B | B | A |
| Ex. 35 | A | B | A |
| Ex. 36 | A | B | A |
| Ex. 37 | A | B | B |
| Ex. 38 | A | A | A |
| Ex. 39 | B | B | A |
| Comp. Ex. 1 | B | C | C |
| Comp. Ex. 2 | B | C | C |
| Comp. Ex. 3 | B | C | C |
| Comp. Ex. 4 | B | C | C |
| Comp. Ex. 5 | B | C | C |
| Comp. Ex. 6 | B | C | C |
| Comp. Ex. 7 | B | C | C |
| Comp. Ex. 8 | C | C | C |
| Comp. Ex. 9 | C | C | C |
| Comp. Ex. 10 | C | C | C |
| Comp. Ex. 11 | C | C | C |
| Comp. Ex. 12 | C | C | C |

TABLE 4

| | | Developing roller conditions | | Evaluation results | | |
|---|---|---|---|---|---|---|
| | Toner | Asker C hardness (degree) | Surface roughness (μm) | Adhesion resistance (NN) | Adhesion resistance (HH) | Thin line reproducibility |
| Ex. 40 | Toner 1 | 58 | 1.1 | C | C | A |
| Ex. 41 | Toner 1 | 62 | 1.1 | B | C | A |
| Ex. 42 | Toner 1 | 66 | 1.1 | B | B | A |
| Ex. 43 | Toner 1 | 78 | 1.1 | B | B | A |
| Ex. 44 | Toner 1 | 81 | 1.1 | B | C | A |
| Ex. 45 | Toner 1 | 87 | 1.1 | C | C | A |
| Ex. 46 | Toner 1 | 72 | 0.4 | B | C | A |
| Ex. 47 | Toner 1 | 72 | 0.6 | B | B | A |
| Ex. 48 | Toner 1 | 72 | 2.9 | B | B | A |
| Ex. 49 | Toner 1 | 72 | 3.1 | B | C | C |
| Comp. Ex. 13 | Toner 105 | 58 | 1.1 | D | D | A |
| Comp. Ex. 14 | Toner 105 | 62 | 1.1 | D | D | A |
| Comp. Ex. 15 | Toner 105 | 66 | 1.1 | D | D | A |
| Comp. Ex. 16 | Toner 105 | 78 | 1.1 | D | D | A |
| Comp. Ex. 17 | Toner 105 | 81 | 1.1 | D | D | A |
| Comp. Ex. 18 | Toner 105 | 87 | 1.1 | D | D | A |
| Comp. Ex. 19 | Toner 105 | 72 | 0.4 | D | D | A |

TABLE 4-continued

| | Toner | Developing roller conditions: Asker C hardness (degree) | Developing roller conditions: Surface roughness (μm) | Evaluation results: Adhesion resistance (NN) | Evaluation results: Adhesion resistance (HH) | Evaluation results: Thin line reproducibility |
|---|---|---|---|---|---|---|
| Comp. Ex. 20 | Toner 105 | 72 | 0.6 | D | D | A |
| Comp. Ex. 21 | Toner 105 | 72 | 2.9 | D | D | A |
| Comp. Ex. 22 | Toner 105 | 72 | 3.1 | D | D | A |

Aspects of the present invention are as follows.

<1> A toner including:

a core particle containing at least a binder resin, a colorant and a releasing agent; and a shell on a surface of the core particle, wherein the toner gives a supernatant having a transmittance of 50% to 95% with respect to light having a wavelength of 800 nm, where the supernatant is formed after 3 g of the toner is added to 40 g of ion-exchange water containing 0.5% by mass of sodium dodecyl sulfate, followed by stirring for 90 min and by irradiating with ultrasonic waves of 20 kHz and 80 W for 5 min, and a liquid containing the toner dispersed therein is centrifugated at 3,000 rpm for 5 min.

<2> The toner according to <1>, wherein the shell contains protrusions and is formed by fine resin particles attached on the surface of the core particle.

<3> The toner according to <2>, wherein the toner is obtained by a method including: dissolving or dispersing, in an organic solvent, the binder resin, the colorant and the releasing agent, to thereby prepare a solution or dispersion liquid; dispersing the solution or dispersion liquid in an aqueous medium to form oil droplets; and attaching the fine resin particles to surfaces of the oil droplets.

<4> The toner according to <2> or <3>, wherein the binder resin contains a non-crystalline polyester resin and the fine resin particles are vinyl fine resin particles and wherein an amount of the vinyl fine resin particles is 3 parts by mass to 15 parts by mass per 100 parts by mass of the core particle.

<5> The toner according to <4>, wherein the vinyl fine resin particles contain 80% by mass or more of an aromatic compound having a vinyl polymerizable functional group.

<6> The toner according to <4> or <5>, wherein the toner has a ratio of intensity at 700 $cm^{-1}$ to intensity at 828 $cm^{-1}$ as measured by attenuated total reflection, the ratio being 0.30 or greater.

<7> The toner according to any one of <1> to <6>, wherein the core particle contains a crystalline polyester resin.

<8> The toner according to any one of <1> to <7>, wherein the core particle contains an isocyanate modified polyester resin.

<9> The toner according to any one of <1> to <8>, wherein the releasing agent is paraffin wax, synthetic ester wax, polyolefin wax, carnauba wax or rice wax or any combination thereof.

<10> The toner according to any one of <1> to <9>, wherein an amount of the releasing agent contained in the toner is 4.0% by mass to 8.0% by mass.

<11> The toner according to any one of <1> to <10>, further including external additive A and external additive B, wherein the external additive A is inorganic fine particles whose surfaces have been treated with silicone oil, and the external additive B is inorganic fine particles whose surfaces have been treated with an amino group-containing silane coupling agent.

<12> The toner according to <11>, wherein the toner has a ratio of intensity at 475 $cm^{-1}$ to intensity at 828 $cm^{-1}$ as measured by attenuated total reflection, the ratio being 0.15 or greater.

<13> A developer including: the toner according to any one of <1> to <12>.

<14> A process cartridge including:

a latent image bearing member; and a developing unit configured to develop, with a toner, a latent electrostatic image on the latent image bearing member, to thereby form a visible image, wherein the process cartridge is detachably mounted to a main body of an image forming apparatus, and wherein the toner is the toner according to any one of <1> to <12>.

<15> An image forming method including:

uniformly charging a surface of a latent image bearing member;

exposing the charged surface of the latent image bearing member to light, to thereby form a latent electrostatic image;

supplying a toner to the latent electrostatic image formed on the surface of the latent image bearing member to form a visible image using a developing roller and a toner-regulating blade where the developing roller is configured to come into contact with the latent image bearing member and bear the toner on a surface thereof and the toner-regulating blade is configured to regulate an amount of the toner on the surface of the developing roller and form a thin layer of the toner;

transferring the visible image from the surface of the latent image bearing member onto a recording medium; and fixing the visible image on the recording medium, wherein the toner is the toner according to any one of <1> to <12>.

<16> An image forming apparatus including:

a latent image bearing member configured to bear a latent image;

a charging unit configured to uniformly charge a surface of the latent image bearing member;

an exposing unit configured to expose the charged surface of the latent image bearing member to light based on image data, to thereby form a latent electrostatic image;

a developing unit including a developing roller and a toner-regulating blade and configured to supply a toner to the latent electrostatic image formed on the surface of the latent image bearing member to form a visible image using the developing roller and the toner-regulating blade where the developing roller is configured to come into contact with the latent image bearing member and bear the toner on a surface thereof and the toner-regulating blade is configured to regulate an amount of the toner on the surface of the developing roller and form a thin layer of the toner;

a transfer unit configured to transfer the visible image from the surface of the image bearing member onto a recording medium; and a fixing unit configured to fix the visible image on the recording medium, wherein the toner is the toner according to any one of <1> to <12>.

<17> The image forming apparatus according to <16>, wherein the fixing unit is a heat-fixing unit.

<18> The image forming apparatus according to <16> or <17>, wherein the developing roller has an Asker C hardness of 60° to 85°.

<19> The image forming apparatus according to any one of <16> to <18>, wherein the developing roller has a surface roughness of 0.5 μm to 3.0 μm.

REFERENCE SIGNS LIST

1 Latent image bearing member
2 Charging device
3 Exposing device
4 Developing device
5 Cleaning part
6 Intermediate transfer medium
7 Supporting roller
8 Transfer roller
9 Heat roller
10 Aluminum core
11 Elastic material layer
12 PFA surface layer
13 Heater
14 Press roller
15 Aluminum core
16 Elastic material layer
17 PFA surface layer
18 Unfixed image
19 Fixing unit
40 Developing roller
41 Thin layer-forming member
42 Supply roller
L Light for exposure
P Recording paper
T Toner

The invention claimed is:

1. A toner, comprising:

a core particle comprising a binder resin, a colorant and a releasing agent; and a shell on a surface of the core particle, wherein a supernatant of the toner has a transmittance of 50% to 95% with respect to light having a wavelength of 800 nm, where the supernatant is obtained by adding 3 g of the toner to 40 g of ion-exchange water comprising 0.5% by mass of sodium dodecyl sulfate to form a mixture, stirring the mixture for 90 min, irradiating the mixture with ultrasonic waves of 20 kHz and 80 W for 5 min, and then centrifuging the mixture at 3,000 rpm for 5 min.

2. The toner of claim 1, wherein the shell comprises a protrusion, and the shell is formed by fine resin particles attached on the surface of the core particle.

3. The toner of claim 2, wherein the toner is obtained by a method comprising: dissolving or dispersing, in an organic solvent, the binder resin, the colorant and the releasing agent, to obtain a solution or dispersion liquid; dispersing the solution or dispersion liquid in an aqueous medium to form oil droplets; and attaching the fine resin particles to surfaces of the oil droplets.

4. The toner of claim 2, wherein the binder resin comprises a non-crystalline polyester resin, the fine resin particles are vinyl fine resin particles, and an amount of the vinyl fine resin particles is 3 parts by mass to 15 parts by mass per 100 parts by mass of the core particle.

5. The toner of claim 4, wherein the vinyl fine resin particles comprise 80% by mass or more of an aromatic compound having a vinyl polymerizable functional group.

6. The toner of claim 4, wherein the toner has a ratio of intensity at 700 $cm^{-1}$ to intensity at 828 $cm^{-1}$ of 0.30 or greater as measured by attenuated total reflection.

7. The toner of claim 1, wherein the core particle comprises a crystalline polyester resin.

8. The toner of claim 1, wherein the core particle comprises an isocyanate modified polyester resin.

9. The toner of claim 1, wherein the releasing agent is at least one selected from the group consisting of paraffin wax, synthetic ester wax, polyolefin wax, carnauba wax, and rice wax.

10. The toner of claim 1, wherein an amount of the releasing agent in the toner is 4.0% by mass to 8.0% by mass.

11. The toner of claim 1, further comprising:

an external additive A; and an external additive B, wherein the external additive A is inorganic fine particles whose surfaces have been treated with silicone oil, and the external additive B is inorganic fine particles whose surfaces have been treated with an amino group-containing silane coupling agent.

12. The toner of claim 11, wherein the toner has a ratio of intensity at 475 $cm^{-1}$ to intensity at 828 $cm^{-1}$ of 0.15 or greater as measured by attenuated total reflection.

13. The toner of claim 1, wherein the shell comprises a plurality of fine resin particles such that a surface of the toner has a sea-island structure in which the surface of the core particle forms a sea and the fine resin particles form islands.

14. The toner of claim 13, wherein a coverage rate of the plurality of fine resin particles on the surface of the toner is from 30 to 90%.

15. The toner of claim 13, wherein the fine resin particles have a diameter of from 100 to 108 nm.

16. A developer, comprising:

a toner, wherein the toner comprises a core particle comprising a binder resin, a colorant and a releasing agent, and a shell on a surface of the core particle, and a supernatant of the toner has a transmittance of 50% to 95% with respect to light having a wavelength of 800 nm, where the supernatant is obtained by adding 3 g of the toner to 40 g of ion-exchange water comprising 0.5% by mass of sodium dodecyl sulfateto form a mixture, stirring the mixture for 90 min, irradiating the mixture with ultrasonic waves of 20 kHz and 80 W for 5 min, and then centrifuging the mixture at 3,000 rpm for 5 min.

17. An image forming apparatus, comprising:

a latent image bearing member configured to bear a latent image;

a charging unit configured to uniformly charge a surface of the latent image bearing member;

an exposing unit configured to expose the charged surface of the latent image bearing member to light based on image data, to thereby form a latent electrostatic image;

a developing unit comprising a developing roller and a toner-regulating blade and configured to supply a toner to the latent electrostatic image formed on the surface of the latent image bearing member to form a visible image using the developing roller and the toner-regulating blade where the developing roller is configured to come into contact with the latent image bearing member and bear the toner on a surface thereof and the toner-regulating blade is configured to regulate an amount of the toner on the surface of the developing roller and form a thin layer of the toner;

a transfer unit configured to transfer the visible image from the surface of the image bearing member onto a recording medium; and a fixing unit configured to fix the visible image on the recording medium, wherein the toner comprises a core particle comprising a binder resin, a colorant and a releasing agent, and a shell on a surface of the core particle, and a supernatant of the toner has a transmittance of 50% to 95% with respect to light having a wavelength of 800 nm, where the supernatant is obtained by adding 3 g of the toner to 40 g of ion-exchange water comprising 0.5% by mass of sodium dodecyl sulfate to form a mixture, stirring the mixture for 90 min, irradiating the mixture with ultrasonic waves of 20 kHz and 80 W for 5 min, and then centrifuging the mixture at 3,000 rpm for 5 min.

18. The image forming apparatus of claim 17, wherein the fixing unit is a heat-fixing unit.

19. The image forming apparatus of claim 17, wherein the developing roller has an Asker C hardness of 60° to 85°.

20. The image forming apparatus of claim 17, wherein the developing roller has a surface roughness of 0.5 μm to 3.0 μm.

* * * * *